US010930218B2

(12) United States Patent
Yoon et al.

(10) Patent No.: US 10,930,218 B2
(45) Date of Patent: Feb. 23, 2021

(54) GATE DRIVER FOR IMPROVING LUMINANCE AND DISPLAY DEVICE INCLUDING THE SAME

(71) Applicant: LG DISPLAY CO., LTD., Seoul (KR)

(72) Inventors: SangHun Yoon, Seoul (KR); WooSung Shim, Hwaseong-si (KR)

(73) Assignee: LG DISPLAY CO., LTD., Seoul (KR)

( * ) Notice: Subject to any disclaimer, the term of this patent is extended or adjusted under 35 U.S.C. 154(b) by 56 days.

(21) Appl. No.: 16/110,855

(22) Filed: Aug. 23, 2018

(65) Prior Publication Data

US 2019/0130841 A1 May 2, 2019

(30) Foreign Application Priority Data

Oct. 27, 2017 (KR) ..... 10-2017-0141400

(51) Int. Cl.

| | |
|---|---|
| ***G09G 3/3266*** | (2016.01) |
| ***G09G 3/36*** | (2006.01) |
| ***G09G 3/3225*** | (2016.01) |
| ***G09G 3/3275*** | (2016.01) |

(52) U.S. Cl.

CPC ..... *G09G 3/3266* (2013.01); *G09G 3/3225* (2013.01); *G09G 3/3275* (2013.01); *G09G 3/3677* (2013.01); *G09G 3/3688* (2013.01); *G09G 2310/0286* (2013.01); *G09G 2310/08* (2013.01); *G09G 2340/0435* (2013.01)

(58) Field of Classification Search

CPC ..... G09G 2310/0286–0297; G09G 2300/0838

See application file for complete search history.

(56) References Cited

U.S. PATENT DOCUMENTS

| | | | | |
|---|---|---|---|---|
| 2014/0139503 | A1 | 5/2014 | Han | |
| 2017/0329194 | A1 | 11/2017 | Kimura | |
| 2018/0108426 | A1* | 4/2018 | Zheng | H01L 27/124 |
| 2018/0226039 | A1* | 8/2018 | Han | G09G 3/3677 |
| 2018/0233099 | A1* | 8/2018 | Wang | G11C 19/287 |
| 2018/0293952 | A1* | 10/2018 | He | G11C 19/28 |

FOREIGN PATENT DOCUMENTS

| | | | |
|---|---|---|---|
| KR | 10-2014-0064482 | A | 5/2014 |
| KR | 10-2016-0030919 | A | 3/2016 |

* cited by examiner

*Primary Examiner* — Sanghyuk Park
(74) *Attorney, Agent, or Firm* — Birch, Stewart, Kolasch & Birch, LLP

(57) ABSTRACT

A gate driver and a display device including the same, are discussed. The gate driver includes a plurality of stages which are dependently connected to each other. Each of the plurality of pixels includes an output unit which outputs a gate voltage by a voltage of an RQ node, a voltage of a PQ node, and a voltage of a QB node, a first controller which controls the RQ node, a second controller which controls the PQ node, and a third controller which controls the QB node. The gate voltage is configured by a first clock signal having a first phase and a second clock signal having a second phase which is different from the first phase.

17 Claims, 12 Drawing Sheets

GATE DRIVER FOR IMPROVING LUMINANCE AND DISPLAY DEVICE INCLUDING THE SAME

CROSS-REFERENCE TO RELATED APPLICATIONS

This application claims the priority of Korean Patent Application No. 10-2017-0141400 filed on Oct. 27, 2017, in the Korean Intellectual Property Office, the disclosure of which is incorporated herein by reference into the present application.

BACKGROUND

Field

The present disclosure relates to a gate driver and a display device including the same, and more particularly, to a gate driver which outputs a gate voltage configured by clock signals having different phases and a display device including the same.

Description of the Related Art

As the information society is developed, demands for display devices for displaying images are increased in various forms. Therefore, recently, various flat panel display devices (FPD) and flexible display devices which are capable of reducing a weight and a volume have been developed and marketed. For example, various display devices such as a liquid crystal display device (LCD), an organic light emitting diode (OLED) display device, and a quantum dot display device are utilized.

A display panel of the display device includes a plurality of pixels which are defined by gate lines and data lines. The display device displays images using a gate driver which supplies gate voltages to the gate lines and a data driver which supplies data voltages to the data lines. The display device controls operation timings of the gate driver and the data driver using a timing controller. The data driver converts digital image data supplied from the timing controller into an analog data voltage to output the converted analog data voltage under the control of the timing controller.

The gate driver includes a shift register to sequentially output the gate voltages. The shift register is configured by a plurality of stages which are dependently connected to each other. The plurality of stages sequentially output the gate voltages to sequentially scan the gate lines disposed on the display panel. Such a gate driver can be disposed in a gate in panel (GIP) type to be embedded in a thin film transistor array substrate of a display panel for integration of a display panel.

Recently, in order to reduce power consumption, a low-speed driving technology in which when the display device outputs a fixed image, on-level gate voltage and data voltage are output only during a writing period and written data is maintained during a sustain period is being studied.

According to the low speed driving, due to the characteristic of the thin film transistor element, the luminance is lowered during the sustain period so that an on-level gate voltage is periodically output also during the sustain period to solve the luminance lowering phenomenon. However, there can be a problem in that the luminance of the display panel is lowered due to the gate voltage which is repeatedly output during the sustain period.

SUMMARY

Therefore, an object to be achieved by the present disclosure is to provide a gate driver which outputs a gate voltage for writing data and a gate voltage for suppressing the lowering of the luminance at different timings during a writing period and a display device including the same.

Technical objects of the present disclosure are not limited to the above-mentioned technical objects, and other technical objects, which are not mentioned above, can be clearly understood by those skilled in the art from the following descriptions.

In order to solve or address the above-described problems, according to an aspect of the present disclosure, a gate driver is provided. The gate driver includes a plurality of stages which are dependently connected to each other, and each of the plurality of pixels includes an output unit which outputs a gate voltage by a voltage of an RQ node, a voltage of a PQ node, and a voltage of a QB node, a first controller which controls the RQ node, a second controller which controls the PQ node, a third controller which controls the QB node. The gate voltage is configured by a first clock signal having a first phase and a second clock signal having a second phase which is different from the first phase.

In order to solve or address the above-described problems, according to another aspect of the present disclosure, a display device is provided. The display device includes a display panel, a gate driver which is mounted in the display panel to output a gate voltage, and a data driver which outputs a data voltage during a writing period and outputs a reference voltage during a sustain period, wherein the gate voltage is configured by a first clock signal having a first phase and a second clock signal having a second phase which is different from the first phase.

Other detailed matters of the embodiments are included in the detailed description and the drawings.

According to the present disclosure, a first clock signal and a second clock signal having different phases are output so that a gate voltage for writing data and a gate voltage for suppressing the lowering of the luminance are output at different timings during the writing period. Therefore, a data voltage to be applied to a pixel connected to a specific gate line is not applied to pixels connected to the remaining gate lines so that the above-mentioned image output failure can be solved.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1A:
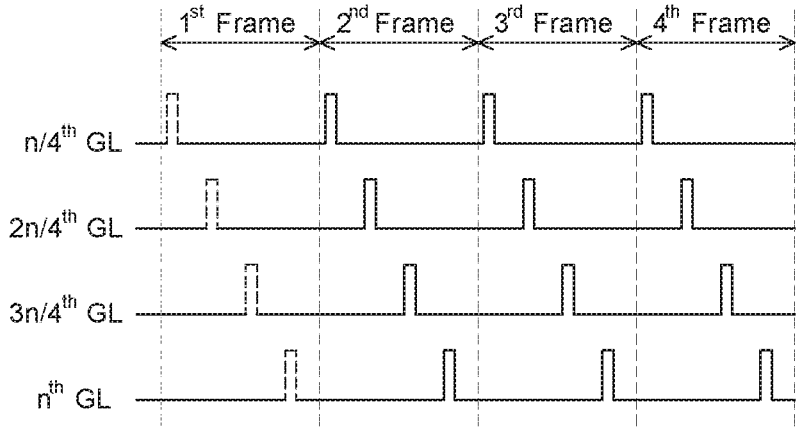
FIGS. 1A and 1B are timing charts illustrating a gate voltage which is generally applied to a gate line of a display device.

Advantages and characteristics of the present disclosure and a method of achieving the advantages and characteristics will be clear by referring to embodiments described below in detail together with the accompanying drawings. However, the present disclosure is not limited to the embodiment disclosed herein but will be implemented in various forms. The embodiments are provided by way of example only so that a person of ordinary skilled in the art can fully understand the disclosures of the present disclosure and the scope of the present disclosure. Therefore, the present disclosure will be defined only by the scope of the appended claims.

And, in the following description, a detailed explanation of known related technologies can be omitted to avoid unnecessarily obscuring the subject matter of the present disclosure. The terms such as "including," "having," and "comprising" used herein are generally intended to allow other components to be added unless the terms are used with the term "only". Any references to singular can include plural unless expressly stated otherwise.

Components are interpreted to include an ordinary error range even if not expressly stated.

Although the terms "first", "second", and the like are used for describing various components, these components are not confined by these terms. These terms are merely used for distinguishing one component from the other components. Therefore, a first component to be mentioned below can be a second component in a technical concept of the present disclosure.

Like reference numerals generally denote like elements throughout the specification.

The features of various embodiments of the present disclosure can be partially or entirely bonded to or combined with each other and can be interlocked and operated in technically various ways understood by those skilled in the art, and the embodiments can be carried out independently of or in association with each other.

Hereinafter, various embodiments of the present disclosure will be described in detail with reference to accompanying drawings.

Figure 1B:
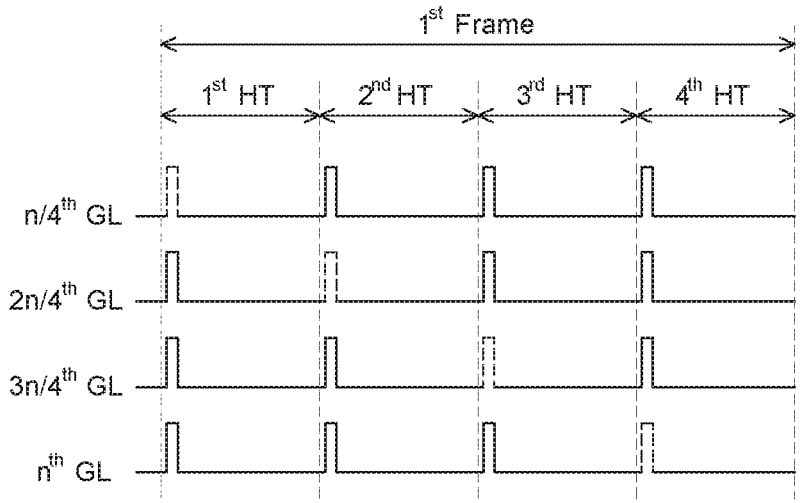

FIGS. 1A and 1B are timing charts illustrating a gate voltage which is generally applied to a gate line of a display device.

As illustrated in FIG. 1A, a data voltage is output only during a first frame ($1^{st}$ Frame) which is a writing period, and the data voltage is not output but a reference voltage is output during second to fourth frames ($2^{nd}$ Frame to $4^{th}$ Frame) which are a sustain period. Therefore, the gate voltage of the first frame ($1^{st}$ Frame) which is the writing period is a voltage (dotted line) for writing data in a pixel. The gate voltage of the second to fourth frames ($2^{nd}$ Frame to $4^{th}$ Frame) which is a sustain period is a voltage (a solid line) for suppressing the lowering of luminance.

However, as illustrated in FIG. 1B, when a frequency of a low-speed driving is increased, the writing period and the sustain period can be divided even in the first frame ($1^{st}$ Frame). That is, with respect to a gate voltage which is applied to a n/4-th gate line (n/$4^{th}$ GL), a first horizontal period ($1^{st}$ HT) when a first pulse is output is a writing period and second to fourth horizontal periods ($2^{nd}$ HT to $4^{th}$ HT) when second to fourth pulses are output can be a sustain period.

That is, when the frequency of the low-speed driving is increased, the voltage which is applied to the n/4-th gate line (n/$4^{th}$ GL) during the first horizontal period ($1^{st}$ HT) is a voltage (dotted line) for writing data, but a voltage which is applied to the remaining 2n/4-th, 3n/4-th, and n-th gate lines (2n/$4^{th}$ GL, 3n/$4^{th}$ GL, and $n^{th}$ GL) is a voltage (solid line) for suppressing the lowering of luminance.

However, since voltages which are applied to all gate lines (n/$4^{th}$ GL, 2n/$4^{th}$ GL, 3n/$4^{th}$ GL, $n^{th}$ GL) have the same phase, the voltages which are applied to all the gate lines (n/$4^{th}$ GL, 2n/$4^{th}$ GL, 3n/$4^{th}$ GL, $n^{th}$ GL) are simultaneously shifted to a high level. Therefore, the data voltage which will be applied to a pixel connected to the n/4-th gate line (n/$4^{th}$ GL) is applied to pixels connected to the remaining 2n/4-th, 3n/4-th, and n-th gate lines (2n/$4^{th}$ GL, 3n/$4^{th}$ GL, and $n^{th}$ GL) so that there can be a problem in that the display panel cannot output an original image.

Figure 2:
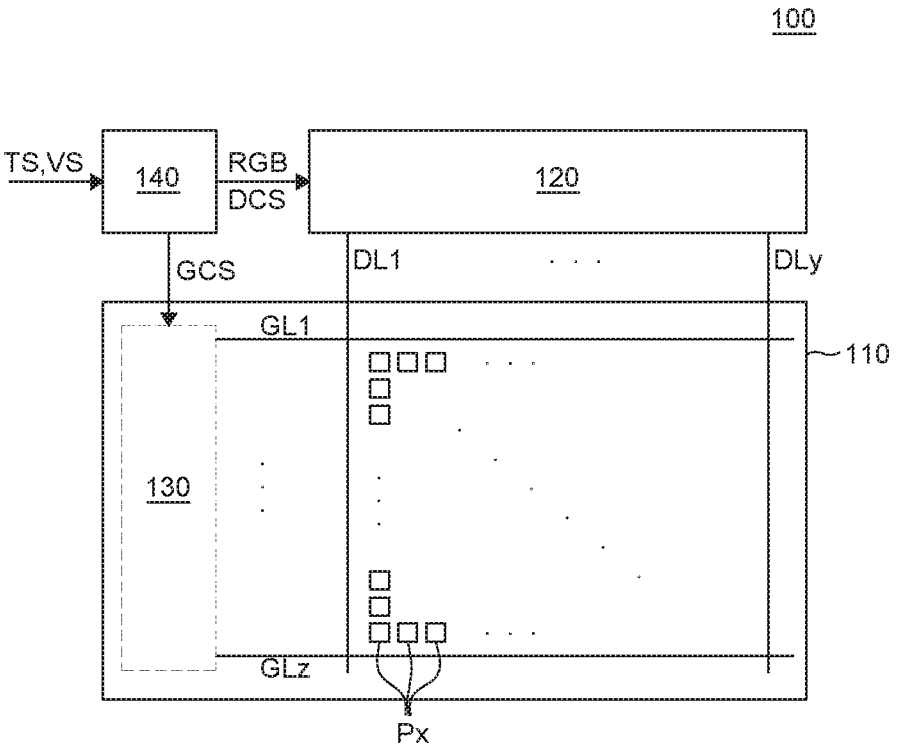
FIG. 2 is a schematic block diagram for explaining a display device according to an embodiment of the present disclosure.

FIG. 2 is a schematic block diagram for explaining a display device according to an embodiment of the present disclosure. All the components of the display device according to all embodiments of the present disclosure are operatively coupled and configured.

Referring to FIG. 2, a display device 100 according to an embodiment of the present disclosure includes a display panel 110, a data driver 120, a gate driver 130, and a timing controller 140.

The display panel 110 includes a plurality of gate lines GL1 to GLz (z is a natural number) and a plurality of data lines DL1 to DLy (y is a natural number) which intersect each other in a matrix on a substrate using glass or plastic. A plurality of pixels Px are defined by the plurality of gate lines GL1 to GLz and the plurality of data lines DL1 to DLy.

Each of the pixels Px of the display panel 110 can include a red sub pixel which emits red light, a green sub pixel which emits green light, a blue sub pixel which emits blue light, and a white sub pixel which emits white light, or any variation thereof.

The plurality of pixels Px of the display panel 110 are connected to the gate lines GL1 to GLz and the data lines DL1 to DLy. The plurality of pixels Px operate based on gate voltages transmitted from the gate lines GL1 to GLz and data voltages transmitted from the data lines DL1 to DLy.

In more detail, a switching transistor is turned on by a gate voltage which is supplied to the gate lines GL1 to GLz of each of the pixels Px. The data voltage is supplied from the data lines DL1 to DLy to a driving transistor by the turned-on switching transistor so that the driving transistor is turned on. A driving current is controlled by the data voltage which is applied to the turned-on driving transistor. Further, an organic light emitting diode emits light corresponding to the controlled driving current to display images.

As described above, the display device 100 according to the embodiment of the present disclosure is not limited to the organic light emitting display device, but can be various types of display devices such as a liquid crystal display device.

The timing controller 140 supplies a data control signal DCS to the data driver 120 to control the data driver 120 and supplies a gate control signal GCS to the gate driver 130 to control the gate driver 130.

That is, the timing controller 140 starts scanning in accordance with a timing implemented by each frame, based on the timing signal TS received from an external host system. The timing controller 140 converts a video signal VS received from the external system according to a data signal format which is processable in the data driver 120 and outputs the converted video signal. By doing this, the timing controller 140 controls data driving at an appropriate timing in accordance with the scanning.

In more detail, the timing controller 140 receives various timing signals TS including a vertical synchronization signal Vsync, a horizontal synchronization signal Hsync, a data enable signal DE, a data clock signal DCLK together with the video signal VS from the external host system.

In order to control the data driver 120 and the gate driver 130, the timing controller 140 receives the timing signal TS such as the vertical synchronization signal Vsync, the horizontal synchronization signal Hsync, the data enable signal DE, and the data clock signal DCLK to generate various control signals DCS and GCS and output the various control signals DCS and GCS to the data driver 120 and the gate driver 130.

For example, in order to control the gate driver 130, the timing controller 140 outputs various gate control signals GCSs including a gate start pulse GSP, a gate shift clock GSC, and a gate output enable signal GOE.

Here, the gate start pulse GSP controls an operation start timing of one or more gate circuits which configure the gate driver 130. The gate shift clock GSC is a clock signal which is commonly input to one or more gate circuits and controls a shift timing of the gate voltage VG. And, the gate output enable signal GOE designates timing information of one or more gate circuits.

As it will be described below, in order to control an RQ node RQ-node and a PQ node PQ-node of each of stages S1 to Sz of the gate driver 130 according to an embodiment of the present disclosure, the gate start pulse GSP can include a first gate start pulse RGSP and a second gate start pulse PGSP. And, the gate shift clock GSC can include a first clock signal RCLK having a first phase and a second clock signal PCLK having a second phase which is different from the first phase.

Here, a pulse width of the first clock signal RCLK and a pulse width of the second clock signal PCLK can be different from each other.

Ad, in order to control the data driver 120, the timing controller 140 outputs various data control signals DCS including a source start pulse SSP, a source sampling clock SSC, and a source output enable signal SOE.

Here, the source start pulse SSP controls a data sampling start timing of one or more data circuits which configure the data driver 120. The source sampling clock SSC is a clock signal which controls a sampling timing of data in each data circuit. The source output enable signal SOE controls an output timing of the data driver 120.

The timing controller 140 can be disposed on a control printed circuit board which is connected to a source printed circuit board to which the data driver 120 is bonded through a connecting medium such as a flexible flat cable (FFC) or a flexible printed circuit (FPC).

The data driver 120 converts image data RGB received from the timing controller 140 into an analog data voltage Vdata to output the analog data voltage to the data lines DL1 to DLy.

In more detail, when the display device 100 is driven at a low speed in order to reduce the power consumption, the data driver 120 outputs a data voltage Vdata for implementing an image during a writing period for writing a data voltage in each pixel Px and outputs a reference voltage Vref during a sustain period for maintaining data written in each pixel Px.

The data driver 120 is connected to a bonding pad of the display panel 110 by a tape automated bonding method or a chip on glass method or can be directly disposed on the display panel 110. As necessary, the data driver 120 can be disposed to be integrated in the display panel 110.

Further, the data driver 120 can be implemented by a chip on film (COF) method. In this case, one end of the data driver 120 can be bonded to at least one source printed circuit board and the other end can be bonded to the display panel 110.

The data driver 120 can include a logic unit including various circuits such as a level shifter or a latch unit, a digital analog converter DAC, and an output buffer.

The gate driver 130 sequentially supplies gate voltages to the gate lines GL1 to GLz in accordance with the control of the timing controller 140.

According to a driving method, the gate driver 130 can be located only at one side of the display panel 110 or located at both sides as necessary.

The gate driver 130 can be connected to a bonding pad of the display panel 110 by a tape automated bonding (TAB) method or a chip on glass (COG) method or as illustrated in FIG. 2, can be implemented to be a gate in panel (GIP) type to be integrated in the display panel 110.

The gate driver 130 can include a shift register and a level shifter.

Hereinafter, a gate driver of a display device according to an embodiment of the present disclosure will be described in detail with reference to FIGS. 3 to 5.

Figure 3:
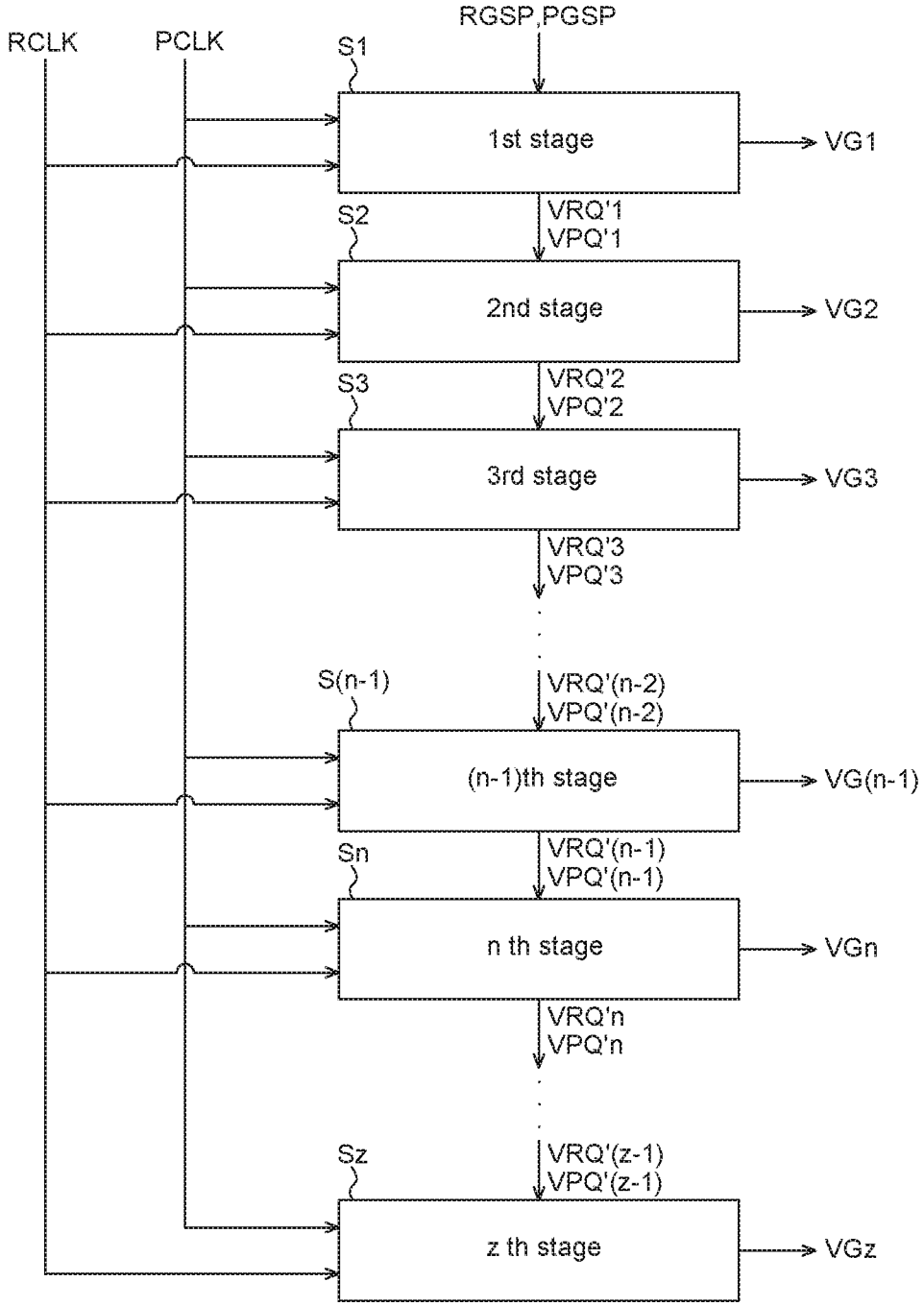
FIG. 3 is a block diagram illustrating a gate driver of a display device according to an embodiment of the present disclosure.

FIG. 3 is a block diagram illustrating a gate driver of a display device according to an embodiment of the present disclosure.

As illustrated in FIG. 3, the gate driver 130 includes first to z-th stages S1 to Sz which sequentially output gate voltages VG1 to VGz in response to a gate shift clock GSC and a gate start pulse GSP supplied from the timing controller 140.

Each of the first to z-th stages S1 to Sz sequentially outputs gate voltages VG1 to VGz selectively including a first clock signal RCLK and a second clock signal PCLK in accordance with RQ' node RQ'-node and PQ' node PQ'-node voltages of a previous stage.

In more detail, a first stage S1 is applied with a first gate start pulse RGSP and a second gate start pulse PGSP to output a first gate voltage VG1 which selectively includes the first clock signal RCLK and the second clock signal PCLK. A second stage S2 is applied with RQ' node and PQ' node voltages VRQ'1 and VPQ'1 of the first stage to output a second gate voltage VG2 which selectively includes the first clock signal RCLK and the second clock signal PCLK. An n-th stage Sn is applied with RQ' node and PQ' node voltages VRQ'(n−1) and VPQ'(n−1) of an n−1-th stage to output an n-th gate voltage VGn which selectively includes the first clock signal RCLK and the second clock signal PCLK.

Figure 4:
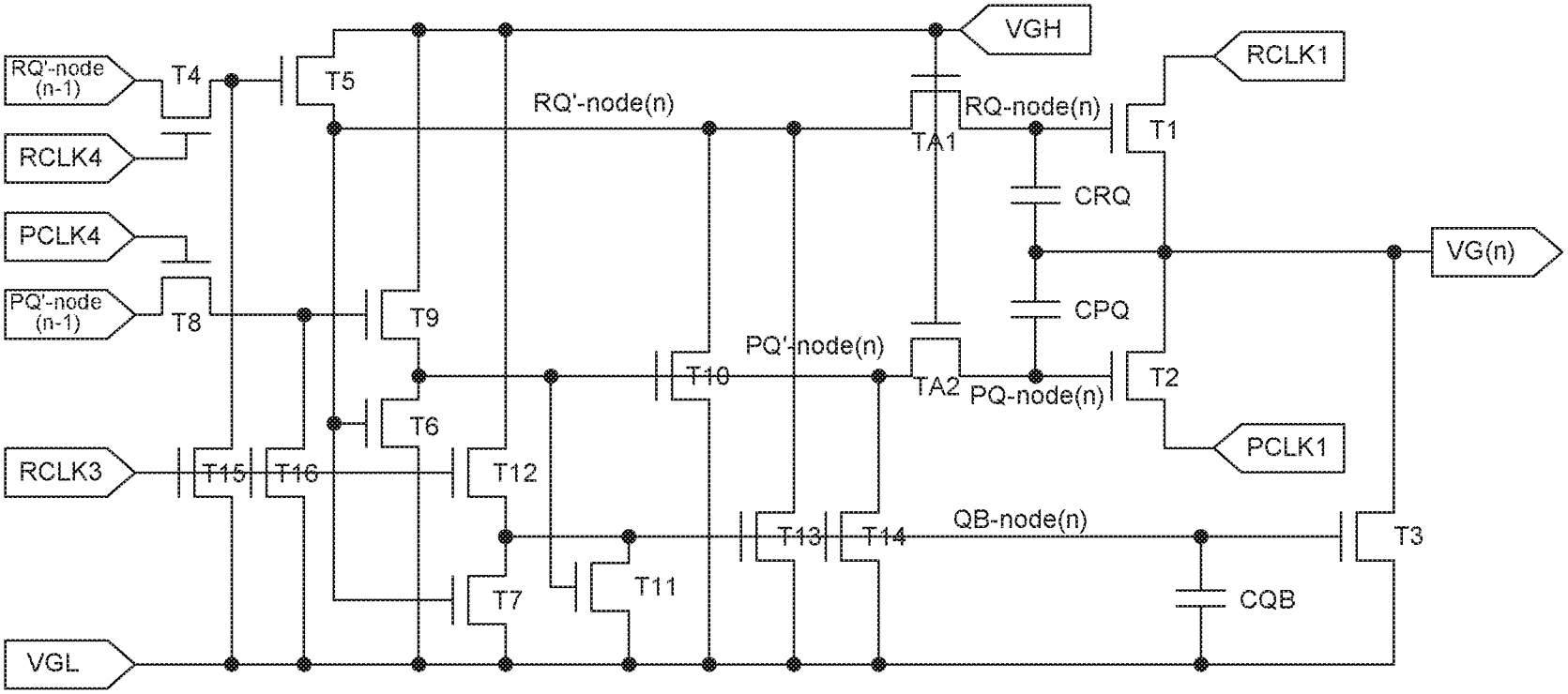
FIG. 4 is a view illustrating an equivalent circuit of each stage equipped in a gate driver of a display device according to an embodiment of the present disclosure.

FIG. 4 is a view illustrating an equivalent circuit of each stage equipped in a gate driver of a display device according to an embodiment of the present disclosure.

Hereinafter, an operation of each stage S1 to Sz which outputs gate voltages VG1 to VGz will be described with the n-th stage Sn as an example. An NMOS will be described as a transistor which will be described below, but it is not limited to thereto, the transistor can be configured by various types of transistors such as PMOS or CMOS.

As illustrated in FIG. 4, the n-th stage includes an output unit which outputs a gate voltage VG(n) by a voltage of the RQ node RQ-node(n), a voltage of the PQ node PQ-node(n), and a voltage of the QB node QB-node(n), a first controller which controls the RQ node RQ-node(n), a second controller which controls the PQ node PQ-node(n), and a third controller which controls the QB node QB-node(n).

The output unit includes a first transistor T1 and a second transistor T2 which pull up the n-th gate voltage VGn and a third transistor T3 which pulls down the gate voltage VGn.

Here, the first transistor T1 is a pull-up transistor in which the RQ node RQ-node(n) is connected to a gate, a first clock signal of a first phase RCLK1 which is an input is applied to a drain, and the gate line GLn which is an output terminal is connected to a source. The first transistor T1 is turned on or off in accordance with a logic state of the RQ node RQ-node(n) and when the first transistor T1 is turned on, the first clock signal of the first phase RCLK1 is output to the n-th gate voltage VGn.

The second transistor T2 is a pull-up transistor in which the PQ node PQ-node(n) is connected to a gate, a second clock signal of a first phase PCLK1 which is an input is applied to a drain, and the gate line GLn which is an output terminal is connected to a source. The second transistor T2 is turned on or off in accordance with a logic state of the PQ node PQ-node(n) and when the second transistor T2 is turned on, the second clock signal of the first phase PCLK1 is output to the n-th gate voltage VGn.

The third transistor T3 is a pull-down transistor in which a QB node QB-node(n) is connected to a gate, a low potential voltage VGL which is an input is applied to a drain, and a gate line GLn which is an output terminal is connected to a source. The third transistor T3 is turned on or off in accordance with a logic state of the QB node QB-node(n) and when the third transistor T3 is turned on, a low potential voltage VGL is output to the n-th gate voltage VGn.

The first controller is applied with the first clock signal RCLK to control a voltage which is applied to the RQ node RQ-node(n) and includes a fourth transistor T4, a fifth transistor T5, a tenth transistor T10, and a thirteenth transistor T13.

Here, the RQ node RQ-node(n) and the RQ' node RQ'-node(n) are connected to each other via a first auxiliary transistor TA1 which is always turned on because the high potential voltage VGH is connected to a gate thereof. Therefore, the RQ node RQ-node(n) and the RQ' node RQ'-node(n) are bootstrapped, so that the same voltage is applied thereto except a timing at which the gate voltage VGn is output.

The fourth transistor T4 is a transistor in which a first clock signal of a fourth phase RCLK4 is applied to a gate, a voltage of the RQ' node RQ'-node(n−1) of a previous stage which is an input is applied to a drain, and a gate of a fifth transistor T5 is connected to a source. The fourth transistor T4 is turned on or off in accordance with a logic state of the first clock signal of a fourth phase RCLK4 and when the fourth transistor T4 is turned on, a voltage of the RQ' node RQ'-node(n−1) of the previous stage is output to the gate of the fifth transistor T5.

The fifth transistor T5 is a transistor in which the voltage of the RQ' node RQ'-node(n−1) of the previous stage is applied to a gate, a high potential voltage VGH which is an input is applied to a drain, and an RQ' node RQ'-node(n) is connected to a source. The fifth transistor T5 is turned on or off in accordance with a logic state of the voltage of the RQ' node RQ'-node(n−1) of the previous stage and when the fifth transistor T5 is turned on, a high potential voltage VGH is output to the RQ' node RQ'-node(n).

The tenth transistor T10 is a transistor in which a PQ' node PQ'-node(n) is connected to a gate, a low potential voltage VGL which is an input is applied to a drain, and the RQ' node RQ'-node(n) is connected to a source. The tenth transistor T10 is turned on or off in accordance with a logic state of a voltage of the PQ' node PQ'-node(n) and when the tenth transistor T10 is turned on, a low potential voltage VGL is output to the RQ' node RQ'-node(n).

The thirteenth transistor T13 is a transistor in which a QB node QB-node(n) is connected to a gate, a low potential voltage VGL which is an input is applied to a drain, and the RQ' node RQ'-node(n) is connected to a source. The thirteenth transistor T13 is turned on or off in accordance with a logic state of a voltage of the QB node QB-node(n) and when the thirteenth transistor T13 is turned on, a low potential voltage VGL is output to the RQ' node RQ'-node (n).

The second controller is applied with the second clock signal PCLK to control a voltage which is applied to the PQ node PQ-node(n) and includes an eighth transistor T8, a ninth transistor T9, a sixth transistor T6, and a fourteenth transistor T14.

Here, the PQ node PQ-node(n) and the PQ' node PQ'-node(n) are connected to each other via a second auxiliary transistor TA2 which is always turned on because the high potential voltage VGH is connected to a gate thereof. Therefore, the PQ node PQ-node(n) and the PQ' node PQ'-node(n) are bootstrapped, so that the same voltage is applied thereto except a timing at which the gate voltage VGn is output.

The eighth transistor T8 is a transistor in which a second clock signal of a fourth phase PCLK4 is applied to a gate, a voltage of the PQ' node PQ'-node(n−1) of a previous stage which is an input is applied to a drain, and a gate of the ninth transistor T9 is connected to a source. The eighth transistor T8 is turned on or off in accordance with a logic state of the second clock signal of a fourth phase PCLK4 and when the eighth transistor T8 is turned on, a voltage of the PQ' node PQ'-node(n−1) of the previous stage is output to the gate of the ninth transistor T9.

The ninth transistor T9 is a transistor in which the voltage of the PQ' node PQ'-node(n−1) of the previous stage is applied to a gate, a high potential voltage VGH which is an input is applied to a drain, and the PQ' node PQ'-node(n) is connected to a source. The ninth transistor T9 is turned on or off in accordance with a logic state of the voltage of the PQ' node PQ'-node(n−1) of the previous stage and when the ninth transistor T9 is turned on, the high potential voltage VGH is output to the PQ' node PQ'-node(n).

The sixth transistor T6 is a transistor in which the RQ' node RQ'-node(n) is connected to a gate, the low potential voltage VGL which is an input is applied to a drain, and the PQ' node PQ'-node(n) is connected to a source. The sixth transistor T6 is turned on or off in accordance with a logic state of a voltage of the RQ' node RQ'-node(n) and when the sixth transistor T6 is turned on, the low potential voltage VGL is output to the PQ' node PQ'-node(n).

The fourteenth transistor T14 is a transistor in which the QB node QB-node(n) is connected to a gate, the low potential voltage VGL which is an input is applied to a drain, and the PQ' node PQ'-node(n) is connected to a source. The fourteenth transistor T14 is turned on or off in accordance with a logic state of the voltage of the QB node QB-node(n) and when the fourteenth transistor T14 is turned on, the low potential voltage VGL is output to the PQ' node PQ'-node (n).

The third controller controls a voltage which is applied to the QB node QB-node(n) and includes a seventh transistor T7, an eleventh transistor T11, and a twelfth transistor T12.

The seventh transistor T7 is a transistor in which the RQ' node RQ'-node(n) is connected to a gate, the low potential voltage VGL which is an input is applied to a drain, and the QB node QB-node(n) is connected to a source. The seventh transistor T7 is turned on or off in accordance with a logic state of the voltage of the RQ' node RQ'-node(n) and when the seventh transistor T7 is turned on, the low potential voltage VGL is output to the QB node QB-node(n).

The eleventh transistor T11 is a transistor in which the PQ' node PQ'-node(n) is connected to a gate, a low potential voltage VGL which is an input is applied to a drain, and the QB node QB-node(n) is connected to a source. The eleventh transistor T11 is turned on or off in accordance with a logic state of the voltage of the PQ' node PQ'-node(n) and when the eleventh transistor T11 is turned on, the low potential voltage VGL is output to the QB node QB-node(n).

The twelfth transistor T12 is a transistor in which a first clock signal RCLK3 of a third phase is applied to a gate, the high potential voltage VGH which is an input is applied to a drain, and the QB node QB-node(n) is connected to a source. The twelfth transistor T12 is turned on or off in accordance with a logic state of the first clock signal RCLK3 of a third phase and when the twelfth transistor T12 is turned on, the high potential voltage VGH is output to the QB node QB-node(n).

And, the n-th stage Sn of the display device according to the embodiment of the present disclosure further includes a fifteenth transistor and a sixteenth transistor for controlling an RQ node RQ-node and a PQ node PQ-node.

The fifteenth transistor T15 is a transistor in which the first clock signal RCLK3 of a third phase is applied to a gate, the low potential voltage VGL which is an input is applied to a drain, and the gate of the fifth transistor T5 is connected to a source. The fifteenth transistor T15 is turned on or off in accordance with a logic state of the first clock signal RCLK3 of a third phase and when the fifteenth transistor T15 is turned on, the low potential voltage VGL is output to the gate of the fifth transistor T5.

The sixteenth transistor T16 is a transistor in which the first clock signal RCLK3 of a third phase is applied to a gate, the low potential voltage VGL which is an input is applied to a drain, and the gate of the ninth transistor T9 is connected to a source. The sixteenth transistor T16 is turned on or off in accordance with a logic state of the first clock signal RCLK3 of a third phase and when the sixteenth transistor T16 is turned on, the low potential voltage VGL is output to the gate of the ninth transistor T9.

Figure 5:
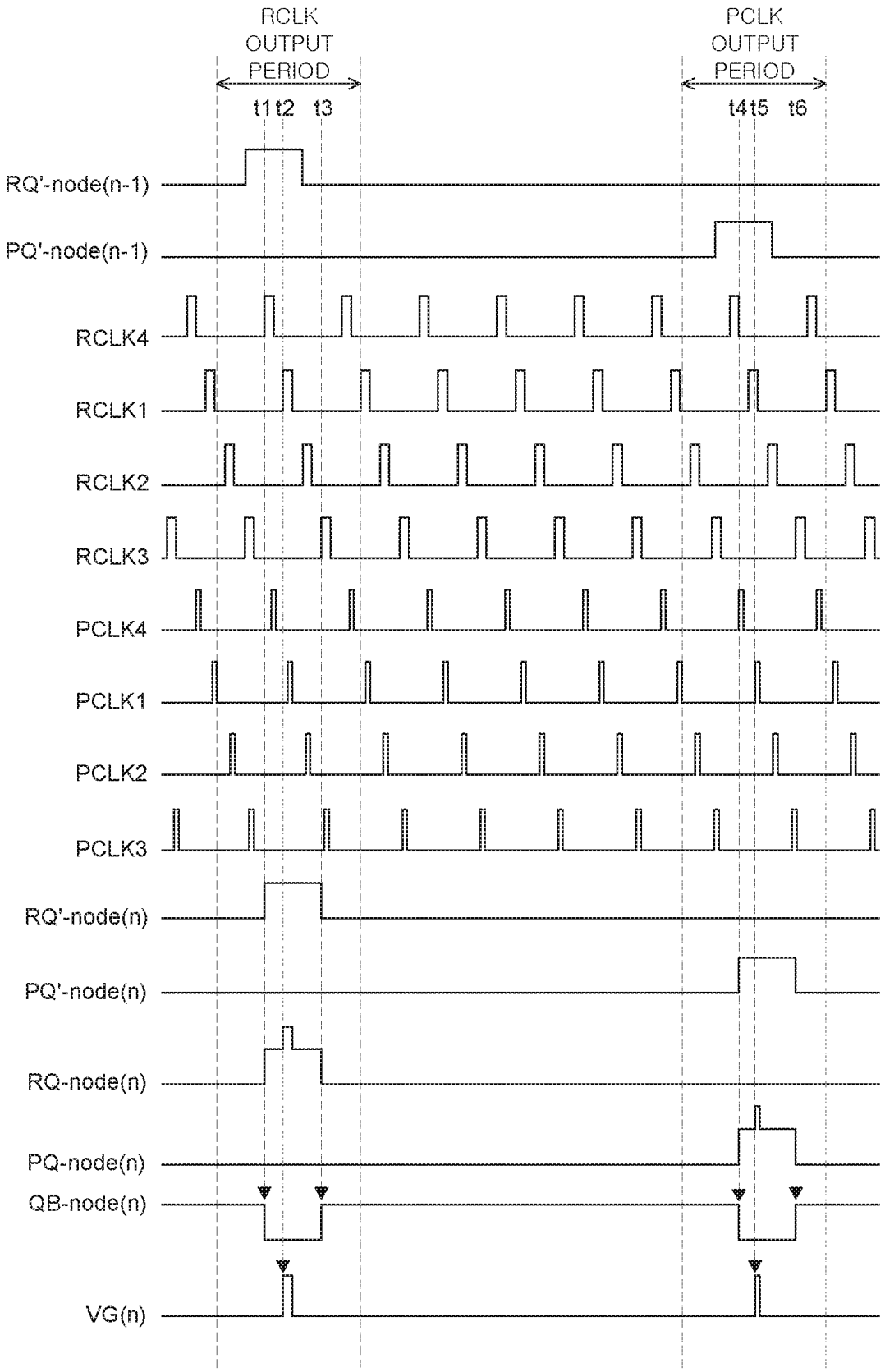
FIGS. 5 and 6 are timing charts illustrating an internal signal of each stage equipped in a gate driver of a display device according to an embodiment of the present disclosure.
Figure 6:
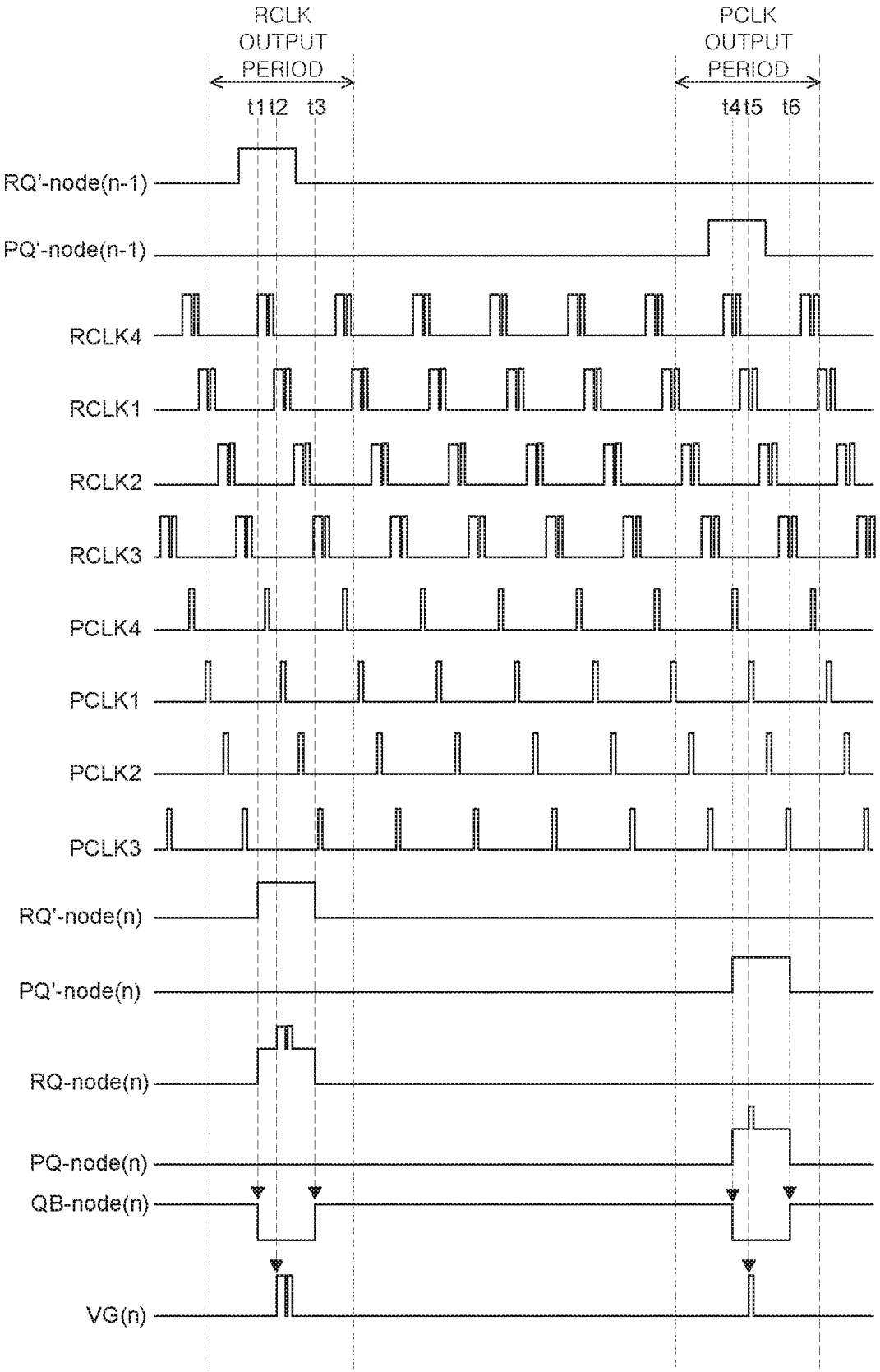

FIGS. 5 and 6 are timing charts illustrating an internal signal of each stage equipped in a gate driver of a display device according to an embodiment of the present disclosure.

As illustrated in FIG. 5, each stage of the gate driver 130 of the display device according to an embodiment of the present disclosure can be driven by dividing a period when a gate voltage VGn outputs a first clock signal RCLK and a period when the gate voltage VGn outputs a second clock signal PCLK.

First, an operation of each stage in the first clock signal RCLK output period will be described as follows.

At a timing t1, when the voltage of the RQ' node RQ'-node(n−1) of the previous stage is a high level, the first clock signal of a fourth phase RCLK4 is shifted to a high level. Therefore, the fourth transistor T4 and the fifth transistor T5 are turned on so that the high potential voltage VGH is applied to the RQ' node RQ'-node(n) and the RQ node RQ-node(n) through the fifth transistor T5.

And, since the high potential voltage VGH is applied to the RQ' node RQ'-node(n) and the RQ node RQ-node(n), the first transistor T1, the sixth transistor T6, and the seventh transistor T7 whose gates are connected to the RQ' node RQ'-node(n) and the RQ node RQ-node(n) are turned on. Therefore, the first clock signal of the first phase RCLK1 is output to the n-th gate line GLn which is an output terminal via the first transistor T1, the low potential voltage VGL is applied to the PQ node PQ-node (n) and the PQ' node PQ'-node(n) via the sixth transistor T6, and the low potential voltage VGL is applied to the QB node QB-node(n) via the seventh transistor T7.

By doing this, the RQ node RQ-node(n) is precharged to the high potential voltage VGH at the timing t1.

Next, at a timing t2, the first clock signal of the first phase RCLK1 is shifted to a high level. A bootstrap circuit is configured by a gate-source capacitor CRQ of the turned-on first transistor T1 and a voltage of the RQ node RQ-node(n) is bootstrapped to be raised due to the voltage shift of the first clock signal of the first phase RCLK1. By doing this, the voltage of the RQ node RQ-node(n) connected to the gate of the first transistor T1 rises and a channel of the first transistor T1 is sufficiently formed so that the high level first clock signal of the first phase RCLK1 is output to the n-th gate voltage VGn.

Next, at a timing t3, the first clock signal RCLK3 of the third phase is shifted to a high level. Therefore, the twelfth transistor T12 and the fifteenth transistor T15 whose gates are applied with the first clock signal RCLK3 of a third phase are turned on. Therefore, the high potential voltage VGH is applied to the QB node QB-node(n) via the twelfth transistor T12 and the low potential voltage VGL is applied to the gate of the fifth transistor T5 via the fifteenth transistor T15 so that the fifth transistor T5 is turned off.

Since the high potential voltage VGH is applied to the QB node QB-node(n), the third transistor T3 and the thirteenth transistor T13 whose gates are connected to the QB node QB-node(n) are turned on.

Therefore, the low potential voltage VGL is applied to the RQ node RQ-node(n) and the RQ' node RQ'-node(n) via the thirteenth transistor T13 and the low potential voltage VGL is output to the n-th gate voltage VGn via the third transistor T3.

Next, an operation of each stage in a second clock signal PCLK output period will be described as follows.

At a timing t4, when the voltage of the PQ' node PQ'-node(n−1) of a previous stage is a high level, the second clock signal of a fourth phase PCLK4 is shifted to a high level. Therefore, the eighth transistor T8 and the ninth transistor T9 are turned on so that the high potential voltage VGH is applied to the PQ' node PQ'-node(n) and the PQ node PQ-node(n) via the ninth transistor T9.

And, since the high potential voltage VGH is applied to the PQ' node PQ'-node(n) and the PQ node PQ-node(n), the second transistor T2, the tenth transistor T10, and the eleventh transistor T11 whose gates are connected to the PQ' node PQ'-node(n) and the PQ node PQ-node(n) are turned on. Therefore, the second clock signal of the first phase PCLK1 is output to the n-th gate line GLn which is an output terminal via the second transistor T2, the low potential voltage VGL is applied to the RQ node RQ-node(n) and the RQ' node RQ'-node(n) via the tenth transistor T10, and the low potential voltage VGL is applied to the QB node QB-node(n) via the eleventh transistor T11.

By doing this, the PQ node PQ-node(n) is precharged to a high potential voltage at the timing t4.

Next, at a timing t5, the second clock signal of the first phase PCLK1 is shifted to a high level. A bootstrap circuit is configured by a gate-source capacitor CPQ of the turned-on second transistor T2 and a voltage of the PQ node PQ-node(n) is bootstrapped to be raised due to the voltage shift of the second clock signal of the first phase PCLK1. By doing this, the voltage of the PQ node PQ-node(n) connected to the gate of the second transistor T2 rises and a channel of the second transistor T2 is sufficiently formed so that a high level second clock signal of the first phase PCLK1 is output to the n-th gate voltage VGn.

Next, at a timing t6, the first clock signal RCLK3 of a third phase is shifted to a high level. Therefore, the twelfth transistor T12 and the sixteenth transistor T16 whose gates are applied with the first clock signal RCLK3 of a third phase are turned on. Therefore, the high potential voltage VGH is applied to the QB node QB-node(n) via the twelfth transistor T12 and the low potential voltage VGL is applied to the gate of the ninth transistor T9 via the sixteenth transistor T16 so that the ninth transistor T9 is turned off.

Since the high potential voltage VGH is applied to the QB node QB-node(n), the third transistor T3 and the fourteenth transistor T14 whose gates are connected to the QB node QB-node(n) are turned on.

Therefore, the low potential voltage VGL is applied to the PQ node PQ-node(n) and the PQ' node PQ'-node(n) via the fourteenth transistor T14 and the low potential voltage VGL is output to the n-th gate voltage VGn via the third transistor T3.

By the above-described processes, the gate driver 130 of the display device according to the embodiment of the present disclosure sequentially outputs gate voltages VG1 to VGz which selectively include the first clock signal RCLK and the second clock signal PCLK having different phases.

As described above, the gate driver 130 outputs the first clock signal RCLK and the second clock signal PCLK having different phases so that a gate voltage for writing data and a gate voltage for suppressing the lowering of the luminance can be output at different timings during the writing period.

Therefore, a data voltage which will be applied to a pixel connected to a specific gate line is not applied to pixels connected to the remaining gate lines so that the above-described image output failure can be solved.

Differently from this, as illustrated in FIG. 6, the first clock signal RCLK according to the embodiment of the present disclosure can be transformed such that the second clock signal PCKL overlaps the first clock signal RCLK.

That is, the first clock signal RCLK can be transformed to include two pulses having different phases. As described above, the first clock signal RCLK is transformed so that a gate voltage including two pulses having different phases can be output within one horizontal time.

That is, the gate driver according to the embodiment of the present disclosure can output a gate voltage including both the first clock signal and the second clock signal or a gate voltage including only the first clock signal during the writing period and output a gate voltage including only the second clock signal during the sustain period.

Hereinafter, a gate driver of a display device according to another embodiment of the present disclosure will be described with reference to FIGS. 7 and 8. A description of another embodiment of the present disclosure which overlaps the embodiment of the present disclosure will be omitted or will be brief.

Figure 7:
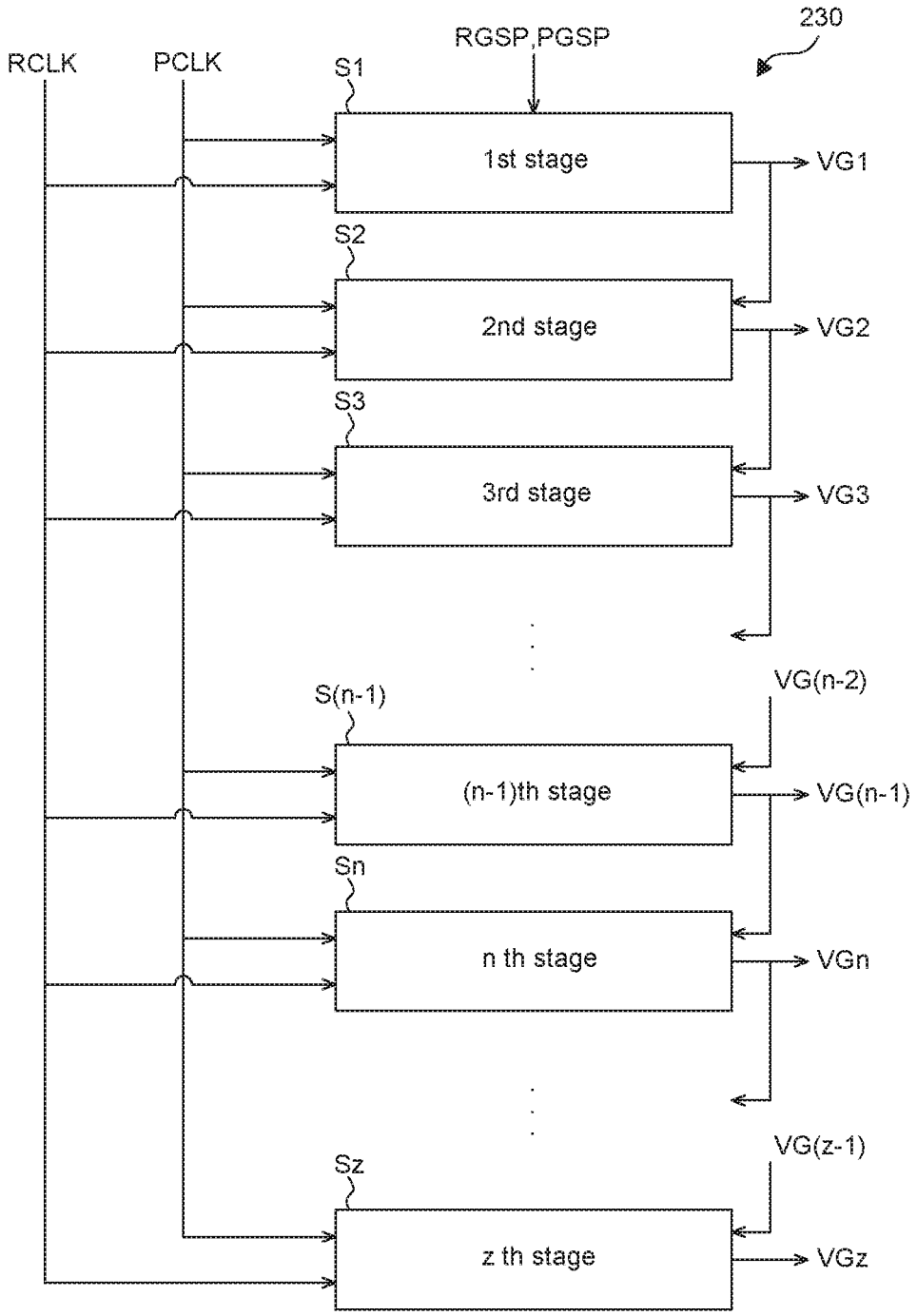
FIG. 7 is a block diagram illustrating a gate driver of a display device according to another embodiment of the present disclosure.

FIG. 7 is a block diagram illustrating a gate driver 230 of a display device according to another embodiment of the present disclosure. The gate driver 230 can be used in lieu of the gate driver 130, in the display device in FIG. 2.

As illustrated in FIG. 7, the gate driver 230 includes first to z-th stages S1 to Sz which sequentially output gate voltages VG1 to VGz in response to a gate shift clock GSC and a gate start pulse GSP supplied from the timing controller 140.

Each of the first to z-th stages S1 to Sz sequentially outputs gate voltages VG1 to VGz selectively including a first clock signal RCLK and a second clock signal PCLK in accordance with a gate voltage VG output from a previous stage.

In more detail, a first stage S1 is applied with a first gate start pulse RGSP and a second gate start pulse PGSP to output a first gate voltage VG1 which selectively includes the first clock signal RCLK and the second clock signal PCLK. A second stage S2 is applied with the first gate voltage VG1 output from the first stage to output a second gate voltage VG2 which selectively includes the first clock signal RCLK and the second clock signal PCLK. An n-th stage Sn is applied with an n−1-th gate voltage VG(n−1) output from an n−1-th stage to output an n-th gate voltage VGn which selectively includes the first clock signal RCLK and the second clock signal PCLK.

Figure 8:
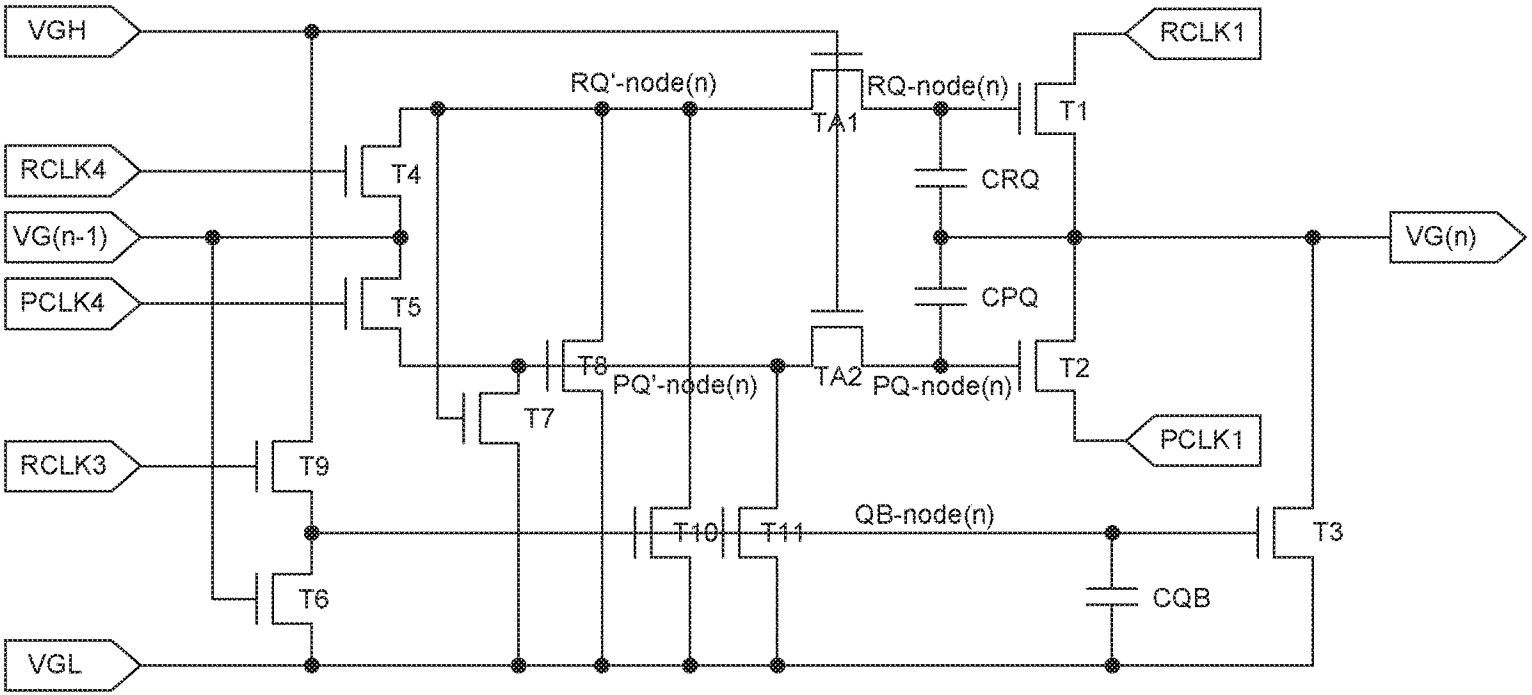
FIG. 8 is a view illustrating an equivalent circuit of each stage equipped in a gate driver of a display device according to another embodiment of the present disclosure.

FIG. 8 is a view illustrating an equivalent circuit of each stage equipped in a gate driver of a display device according to another embodiment of the present disclosure.

Hereinafter, an operation of each stage S1 to Sz which outputs gate voltages VG1 to VGz will be described with the n-th stage Sn as an example. An NMOS will be described as a transistor which will be described below, but it is not limited to thereto, the transistor can be configured by various types of transistors such as PMOS or CMOS.

As illustrated in FIG. 8, the n-th stage includes an output unit which outputs a gate voltage VG(n) by a voltage of an RQ node RQ-node(n), a voltage of a PQ node PQ-node(n), and a voltage of a QB node QB-node(n), a first controller which controls the RQ node RQ-node(n), a second controller which controls the PQ node PQ-node(n), and a third controller which controls the QB node QB-node(n).

The output unit includes a first transistor T1 and a second transistor T2 which pull up the n-th gate voltage VGn and a third transistor T3 which pulls down the gate voltage VGn.

The first controller is applied with the first clock signal RCLK to control a voltage which is applied to the RQ node RQ-node(n) and includes a fourth transistor T4, an eighth transistor T8, and a tenth transistor T10.

Here, the RQ node RQ-node(n) and an RQ' node RQ'-node(n) are connected to each other via a first auxiliary transistor TA1 which is always turned on because the high potential voltage VGH is connected to a gate thereof. Therefore, the RQ node RQ-node(n) and the RQ' node RQ'-node(n) are bootstrapped, so that the same voltage is applied thereto except a timing at which the gate voltage VGn is output.

The fourth transistor T4 is a transistor in which a first clock signal of a fourth phase RCLK4 is applied to a gate, a gate voltage VG(n−1) of a previous stage which is an input is applied to a drain, and the RQ' node RQ'-node(n) is connected to a source. The fourth transistor T4 is turned on or off in accordance with a logic state of the first clock signal of a fourth phase RCLK4 and when the fourth transistor T4 is turned on, the gate voltage VG(n−1) of the previous stage is output to the RQ' node RQ'-node(n).

The eighth transistor T8 is a transistor in which a PQ' node PQ'-node(n) is connected to a gate, a low potential voltage VGL which is an input is applied to a drain, and the RQ' node RQ'-node(n) is connected to a source. The eighth transistor T8 is turned on or off in accordance with a logic state of the voltage of the PQ' node PQ'-node(n) and when the eighth transistor T8 is turned on, the low potential voltage VGL is output to the RQ' node RQ'-node(n).

The tenth transistor T10 is a transistor in which the QB node QB-node(n) is connected to a gate, the low potential voltage VGL which is an input is applied to a drain, and the RQ' node RQ'-node(n) is connected to a source. The tenth transistor T10 is turned on or off in accordance with a logic state of the voltage of the QB node QB-node(n) and when the tenth transistor T10 is turned on, the low potential voltage VGL is output to the RQ' node RQ'-node(n).

The second controller is applied with the second clock signal PCLK to control a voltage which is applied to the PQ node PQ-node(n) and includes a fifth transistor T5, a seventh transistor T7, and an eleventh transistor T11.

Here, the PQ node PQ-node(n) and the PQ' node PQ'-node(n) are connected to each other via a second auxiliary transistor TA2 which is always turned on because the high potential voltage VGH is connected to the gate. Therefore, the PQ node PQ-node(n) and the PQ' node PQ'-node(n) are bootstrapped, so that the same voltage is applied thereto except a timing at which the gate voltage VGn is output.

The fifth transistor T5 is a transistor in which a second clock signal of a fourth phase PCLK4 is applied to a gate, the gate voltage VG(n−1) of the previous stage which is an input is applied to a drain, and the PQ' node PQ'-node(n) is connected to a source. The fifth transistor T5 is turned on or off in accordance with a logic state of the second clock signal of a fourth phase PCLK4 and when the fifth transistor T5 is turned on, the gate voltage VG(n−1) of the previous stage is output to the PQ' node PQ'-node(n).

The seventh transistor T7 is a transistor in which the RQ' node RQ'-node(n) is connected to a gate, the low potential voltage VGL which is an input is applied to a drain, and the PQ' node PQ'-node(n) is connected to a source. The seventh transistor T7 is turned on or off in accordance with a logic state of the voltage of the RQ' node RQ'-node(n) and when the seventh transistor T7 is turned on, the low potential voltage VGL is output to the PQ' node PQ'-node(n).

The eleventh transistor T11 is a transistor in which the QB node QB-node(n) is connected to a gate, the low potential voltage VGL which is an input is applied to a drain, and the PQ' node PQ'-node(n) is connected to a source. The eleventh transistor T11 is turned on or off in accordance with a logic state of the voltage of the QB node QB-node(n) and when the eleventh transistor T11 is turned on, the low potential voltage VGL is output to the PQ' node PQ'-node(n).

The third controller controls a voltage which is applied to the QB node QB-node(n) and includes a sixth transistor T6 and a ninth transistor T9.

The sixth transistor T6 is a transistor in which the gate voltage VG(n−1) of the previous stage is applied to a gate, the low potential voltage VGL which is an input is applied to a drain, and the QB node QB-node(n) is connected to a source. The sixth transistor T6 is turned on or off in accordance with a logic state of the gate voltage VG(n−1) of the previous stage and when the sixth transistor T6 is turned on, the low potential voltage VGL is output to the QB node QB-node(n).

The ninth transistor T9 is a transistor in which a first clock signal RCLK3 of a third phase is applied to a gate, the high potential voltage VGH which is an input is applied to a drain, and the QB node QB-node(n) is connected to a source. The ninth transistor T9 is turned on or off in accordance with a logic state of the first clock signal RCLK3 of a third phase and when the ninth transistor T9 is turned on, a high potential voltage VGH is output to the QB node QB-node (n).

Figure 9:
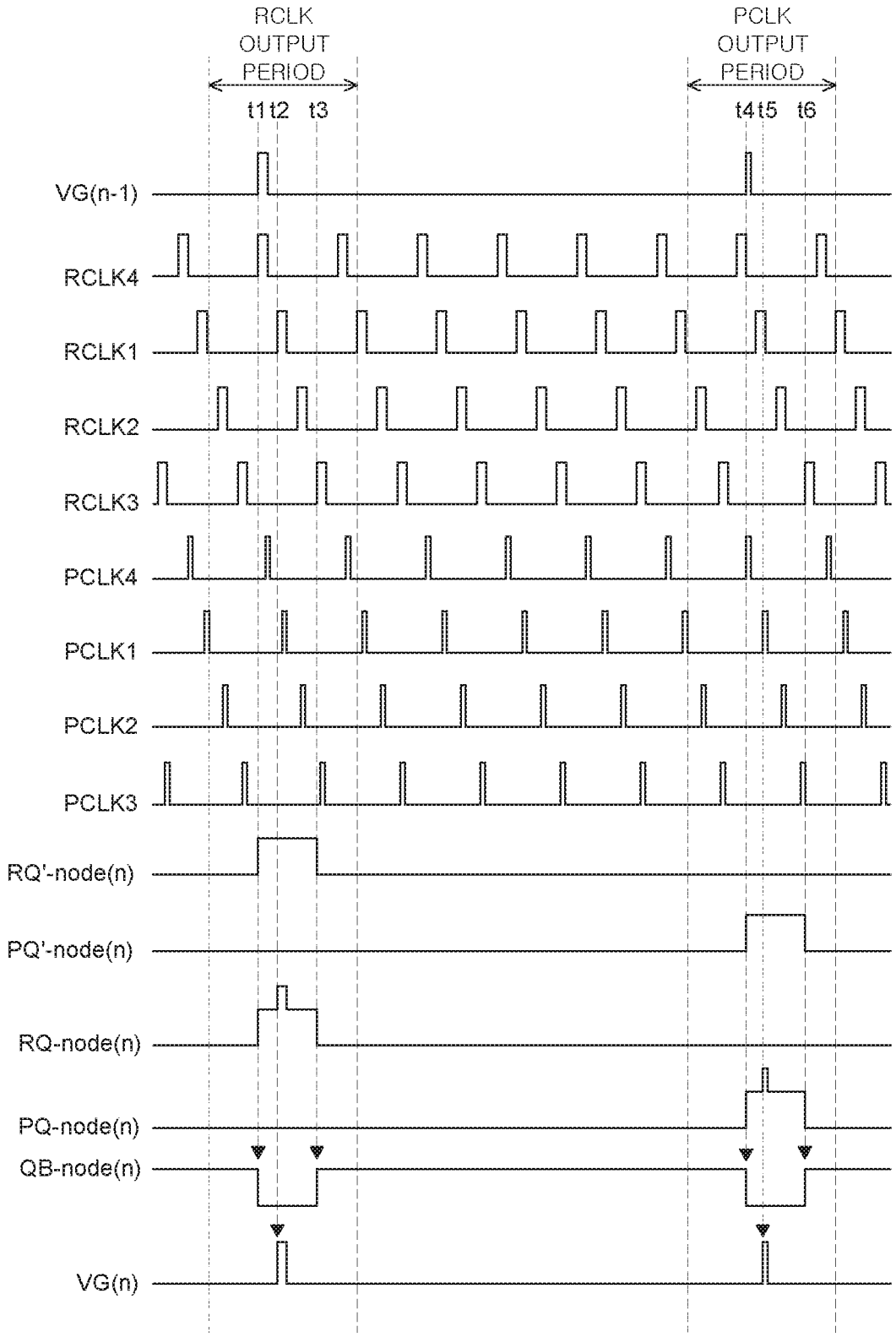
FIG. 9 is a timing chart illustrating an internal signal of each stage equipped in a gate driver of a display device according to another embodiment of the present disclosure.

FIG. 9 is a timing chart illustrating an internal signal of each stage equipped in a gate driver of a display device according to another embodiment of the present disclosure.

As illustrated in FIG. 9, each stage of the gate driver 230 of the display device according to an embodiment of the present disclosure can be driven by dividing a period when a gate voltage VGn outputs a first clock signal RCLK and a period when the gate voltage VGn outputs a second clock signal PCLK.

First, an operation of each stage in the first clock signal RCLK output period will be described as follows.

At a timing t1, a gate voltage VG(n−1) of a previous stage and a first clock signal of a fourth phase RCLK4 are shifted to a high level. Therefore, the fourth transistor T4 is turned on so that a high level gate voltage VG(n−1) is applied to the RQ' node RQ'-node(n) and the RQ node RQ-node(n) via the fourth transistor T4.

And, since the high level gate voltage VG(n−1) is applied to the RQ' node RQ'-node(n) and the RQ node RQ-node(n), the first transistor T1 and the seventh transistor T7 whose gates are connected to the RQ' node RQ'-node(n) and the RQ node RQ-node(n) are turned on. Therefore, a first clock signal of a first phase RCKL1 is output to the n-th gate line GLn which is an output terminal via the first transistor T1, the low potential voltage VGL is applied to the PQ node PQ-node(n) and the PQ' node PQ'-node(n) via the seventh transistor T7.

And, the gate voltage VG(n−1) of the previous stage is shifted to a high level so that the sixth transistor T6 is turned on. Therefore, the low potential voltage VGL is applied to the QB node QB-node(n).

By doing this, the RQ node RQ-node(n) is precharged to the high potential voltage VGH at the timing t1.

Next, at a timing t2, the first clock signal of the first phase RCLK1 is shifted to a high level. A bootstrap circuit is configured by a gate-source capacitor CRQ of the turned-on first transistor T1 and a voltage of the RQ node RQ-node(n) is bootstrapped to be raised due to the voltage shift of the first clock signal of the first phase RCLK1. By doing this, the voltage of the RQ node RQ-node(n) connected to the gate of the first transistor T1 rises and a channel of the first transistor T1 is sufficiently formed so that the high level first clock signal of the first phase RCLK1 is output to the n-th gate voltage VGn.

Next, at a timing t3, a first clock signal RCLK3 of a third phase is shifted to a high level. Therefore, the ninth transistor T9 whose gate is applied with the first clock signal RCLK3 of a third phase is turned on. Therefore, the high potential voltage VGH is applied to the QB node QB-node (n) via the ninth transistor T9.

Since the high potential voltage VGH is applied to the QB node QB-node(n), the third transistor T3 and the tenth transistor T10 whose gates are connected to the QB node QB-node(n) are turned on.

Therefore, the low potential voltage VGL is applied to the RQ node RQ-node(n) and the RQ' node RQ'-node(n) via the tenth transistor T10 and the low potential voltage VGL is output to the n-th gate voltage VGn via the third transistor T3.

Next, an operation of each stage in a second clock signal PCLK output period will be described as follows.

At a timing t4, a gate voltage VG(n−1) of a previous stage and a second clock signal of a fourth phase PCLK4 are shifted to a high level. Therefore, the fifth transistor T5 is turned on so that a high level gate voltage VG(n−1) is applied to the PQ' node PQ'-node(n) and the PQ node PQ-node(n) via the fifth transistor T5.

And, since the high level gate voltage VG(n−1) is applied to the PQ' node PQ'-node(n) and the PQ node PQ-node(n), the second transistor T2 and the eighth transistor T8 whose gates are connected to the PQ' node PQ'-node(n) and the PQ node PQ-node(n) are turned on. Therefore, the second clock signal of the first phase PCLK1 is output to the n-th gate line GLn which is an output terminal via the second transistor T2 and the low potential voltage VGL is applied to the RQ node RQ-node(n) and the RQ' node RQ'-node(n) via the eighth transistor T8.

And, the gate voltage VG(n−1) of the previous stage is shifted to a high level so that the sixth transistor T6 is turned on. Therefore, the low potential voltage VGL is applied to the QB node QB-node(n).

By doing this, the PQ node PQ-node(n) is precharged to a high potential voltage at the timing t4.

Next, at a timing t5, a second clock signal of a first phase PCLK1 is shifted to a high level. A bootstrap circuit is configured by a gate-source capacitor CPQ of the turned-on second transistor T2 and a voltage of the PQ node PQ-node (n) is bootstrapped to be raised due to the voltage shift of the second clock signal of the first phase PCLK1. By doing this, the voltage of the PQ node PQ-node(n) connected to the gate of the second transistor T2 rises and a channel of the second transistor T2 is sufficiently formed so that the high level second clock signal of the first phase PCLK1 is output to the n-th gate voltage VGn.

Next, at a timing t6, a first clock signal RCLK3 of a third phase is shifted to a high level. Therefore, the ninth transistor T9 whose gate is applied with the first clock signal RCLK3 of the third phase is turned on. Therefore, the high potential voltage VGH is applied to the QB node QB-node (n) via the ninth transistor T9.

Since the high potential voltage VGH is applied to the QB node QB-node(n), the third transistor T3 and the eleventh transistor T11 whose gates are connected to the QB node QB-node(n) are turned on.

Therefore, the low potential voltage VGL is applied to the PQ node PQ-node(n) and the PQ' node PQ'-node(n) via the eleventh transistor T11 and the low potential voltage VGL is output to the n-th gate voltage VGn via the third transistor T3.

By the above-described processes, the gate driver 230 of the display device according to another embodiment of the present disclosure sequentially outputs gate voltages VG1 to VGz which selectively includes the first clock signal RCLK and the second clock signal PCLK having different phases.

As described above, the gate driver 230 of the display device according to another embodiment of the present disclosure outputs the first clock signal RCLK and the second clock signal PCLK having different phase so that a gate voltage for writing data and a gate voltage for suppressing the lowering of the luminance are output at different timings during the writing period.

Therefore, a data voltage which will be applied to a pixel connected to a specific gate line is not applied to pixels connected to the remaining gate lines so that the above-described image output failure can be solved.

Hereinafter, a gate driver of a display device according to another embodiment of the present disclosure will be described with reference to FIGS. 7 and 8. A description of another embodiment of the present disclosure which overlaps the embodiment of the present disclosure will be omitted or will be brief.

Figure 10:
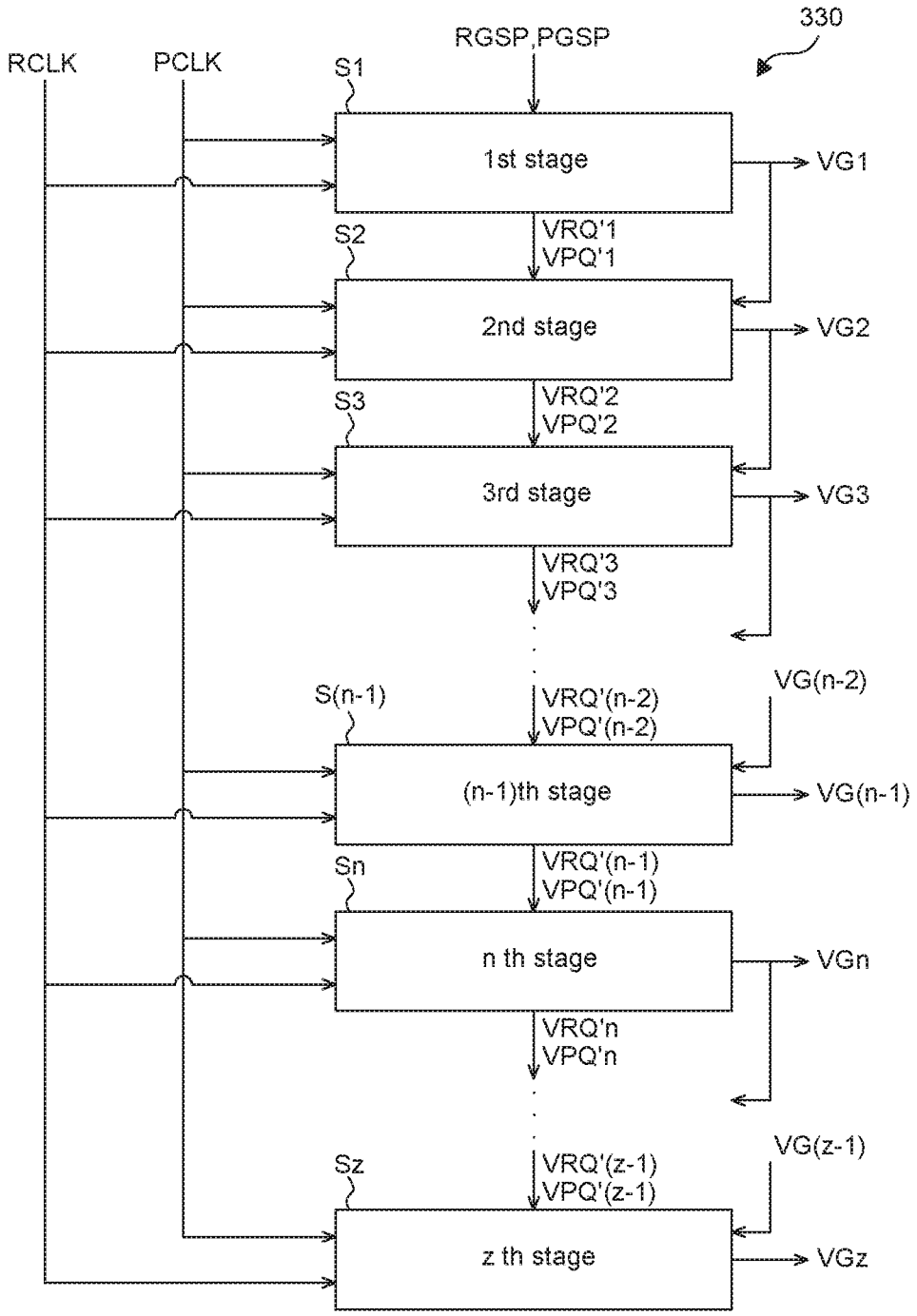
FIG. 10 is a block diagram illustrating a gate driver of a display device according to still another embodiment of the present disclosure.

FIG. 10 is a block diagram illustrating a gate driver 330 of a display device according to still another embodiment of the present disclosure. The gate driver 330 can be used in lieu of the gate driver 130, in the display device of FIG. 1.

As illustrated in FIG. 10, the gate driver 330 includes first to z-th stages S1 to Sz which sequentially output gate voltages VG1 to VGz in response to a gate shift clock GSC and a gate start pulse GSP supplied from the timing controller 140.

Each of the first to z-th stages S1 to Sz sequentially outputs gate voltages VG1 to VGz selectively including a first clock signal RCLK and a second clock signal PCLK in accordance with the gate voltage VG output from the previous stage and RQ' node and PQ' node voltages of the previous stage.

In more detail, a first stage S1 is applied with a first gate start pulse RGSP and a second gate start pulse PGSP to output a first gate voltage VG1 which selectively includes the first clock signal RCLK and the second clock signal PCLK. A second stage S2 is applied with the first gate voltage VG1 and the RQ' node and PQ' node voltages VRQ'1 and VPQ'1 output from the first stage to output a second gate voltage VG2 which selectively includes the first clock signal RCLK and the second clock signal PCLK. An n-th stage Sn is applied with an n−1-th gate voltage VG(n−1) and RQ' node and PQ' node voltages VRQ'(n−1) and VPQ' (n−1) output from the n−1-th stage to output an n-th gate voltage VGn which selectively includes the first clock signal RCLK and the second clock signal PCLK.

Figure 11:
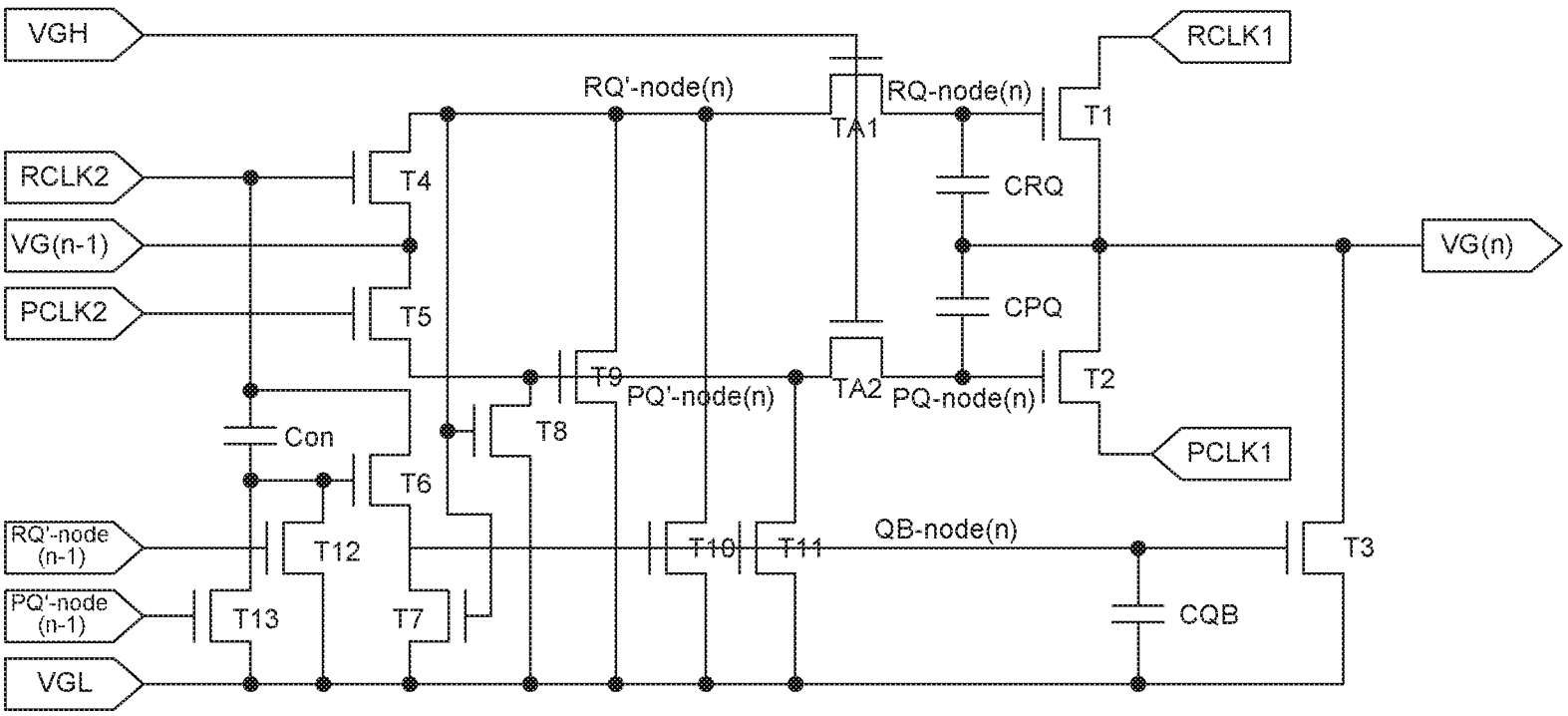
FIG. 11 is a view illustrating an equivalent circuit of each stage equipped in a gate driver of a display device according to an embodiment of the present disclosure.

FIG. 11 is a view illustrating an equivalent circuit of each stage equipped in a gate driver of a display device according to an embodiment of the present disclosure.

Hereinafter, an operation of each stage S1 to Sz which outputs gate voltages VG1 to VGz will be described with the n-th stage Sn as an example. An NMOS will be described as a transistor which will be described below, but the transistor can be configured by various types of transistors such as PMOS or CMOS.

As illustrated in FIG. 11, the n-th stage includes an output unit which outputs a gate voltage VG(n) by a voltage of an RQ node RQ-node(n), a voltage of a PQ node PQ-node(n), and a voltage of a QB node QB-node(n), a first controller which controls an RQ node RQ-node(n), a second controller which controls the PQ node PQ-node(n), and a third controller which controls the QB node QB-node(n).

The output unit includes a first transistor T1 and a second transistor T2 which pull up the n-th gate voltage and a third transistor T3 which pulls down the gate voltage VGn.

The first controller is applied with the first clock signal RCLK to control a voltage which is applied to the RQ node RQ-node(n) and includes a fourth transistor T4, a ninth transistor T9, and a tenth transistor T10.

Here, the RQ node RQ-node(n) and the RQ' node RQ'-node(n) are connected to each other via a first auxiliary transistor TA1 which is always turned on because the high potential voltage VGH is connected to the gate. Therefore, the RQ node RQ-node(n) and the RQ' node RQ'-node(n) are bootstrapped, so that the same voltage is applied thereto except a timing at which the gate voltage VGn is output.

The fourth transistor T4 is a transistor in which a first clock signal of a second phase RCLK2 is applied to a gate, a gate voltage VG(n−1) of a previous stage which is an input is applied to a drain, and an RQ' node RQ'-node(n) is connected to a source. The fourth transistor T4 is turned on or off in accordance with a logic state of the first clock signal of a second phase RCLK2 and when the fourth transistor T4 is turned on, a gate voltage VG(n−1) of the previous stage is output to the RQ' node RQ'-node(n).

The ninth transistor T9 is a transistor in which a PQ' node PQ'-node(n) is connected to a gate, a low potential voltage VGL which is an input is applied to a drain, and the RQ' node RQ'-node(n) is connected to a source. The ninth transistor T9 is turned on or off in accordance with a logic state of the voltage of the PQ' node PQ'-node(n) and when the ninth transistor T9 is turned on, a low potential voltage VGL is output to the RQ' node RQ'-node(n).

The tenth transistor T10 is a transistor in which the QB node QB-node(n) is connected to a gate, the low potential voltage VGL which is an input is applied to a drain, and the RQ' node RQ'-node(n) is connected to a source. The tenth transistor T10 is turned on or off in accordance with a logic state of the voltage of the QB node QB-node(n) and when the tenth transistor T10 is turned on, the low potential voltage VGL is output to the RQ' node RQ'-node(n).

The second controller is applied with the second clock signal PCLK to control a voltage which is applied to the PQ node PQ-node(n) and includes a fifth transistor T5, an eighth transistor T8, and an eleventh transistor T11.

Here, the PQ node PQ-node(n) and the PQ' node PQ'-node(n) are connected to each other via a second auxiliary transistor TA2 which is always turned on because the high potential voltage VGH is connected to the gate. Therefore, the PQ node PQ-node(n) and the PQ' node PQ'-node(n) are bootstrapped, so that the same voltage is applied thereto except a timing at which the gate voltage VGn is output.

The fifth transistor T5 is a transistor in which a second clock signal of a second phase PCLK2 is applied to a gate, a gate voltage VG(n−1) of a previous stage which is an input is applied to a drain, and the PQ' node PQ'-node(n) is connected to a source. The fifth transistor T5 is turned on or off in accordance with a logic state of the second clock signal of a second phase PCLK2 and when the fifth transistor T5 is turned on, the gate voltage VG(n−1) of the previous stage is output to the PQ' node PQ'-node(n).

The eighth transistor T8 is a transistor in which an RQ' node RQ'-node(n) is connected to a gate, the low potential voltage VGL which is an input is applied to a drain, and the PQ' node PQ'-node(n) is connected to a source. The eighth transistor T8 is turned on or off in accordance with a logic state of the voltage of the RQ' node RQ'-node(n) and when the eighth transistor T8 is turned on, the low potential voltage VGL is output to the PQ' node PQ'-node(n).

The eleventh transistor T11 is a transistor in which a QB node QB-node(n) is connected to a gate, the low potential voltage VGL which is an input is applied to a drain, and the PQ' node PQ'-node(n) is connected to a source. The eleventh transistor T11 is turned on or off in accordance with a logic state of the voltage of the QB node QB-node(n) and when the eleventh transistor T11 is turned on, the low potential voltage VGL is output to the PQ' node PQ'-node(n).

The third controller controls a voltage which is applied to the QB node QB-node(n) and includes a sixth transistor T6 and a seventh transistor T7.

The sixth transistor T6 is a transistor in which another electrode of a capacitor Con to which a first clock signal of a second phase RCLK2 is applied is connected to one electrode of a gate, the first clock signal of a second phase RCLK2 which is an input is applied to a drain, and the QB node QB-node(n) is connected to a source. The sixth transistor T6 is turned on or off in accordance with a logic state of a coupling voltage of the first clock signal of a second phase RCLK2 of the other electrode of the capacitor Con and when the sixth transistor T6 is turned on, the first clock signal of a second phase RCLK2 is output to the QB node QB-node(n).

The seventh transistor T7 is a transistor in which the RQ' node RQ'-node(n) is connected to a gate, the low potential voltage VGL which is an input is applied to a drain, and the QB node QB-node(n) is connected to a source. The seventh transistor T7 is turned on or off in accordance with a logic state of the voltage of the RQ' node RQ'-node(n) and when the seventh transistor T7 is turned on, the low potential voltage VGL is output to the QB node QB-node(n).

The n-th stage Sn of the display device according to another embodiment of the present disclosure can further include a twelfth transistor T12 and a thirteenth transistor T13 to control the gate of the sixth transistor T6.

The twelfth transistor T12 is a transistor in which a voltage of an RQ' node RQ'-node(n−1) of a previous stage is applied to a gate, the high potential voltage VGH which is an input is applied to a drain, and a gate of the sixth transistor T6 is connected to a source. The twelfth transistor T12 is turned on or off in accordance with a logic state of a voltage of the RQ' node RQ'-node(n−1) of the previous stage and when the twelfth transistor T12 is turned on, the low potential voltage VGL is output to the gate of the sixth transistor T6.

The thirteenth transistor T13 is a transistor in which a voltage of a PQ' node PQ'-node(n−1) of a previous stage is applied to a gate, a low potential voltage VGL which is an input is applied to a drain, and the gate of the sixth transistor T6 is connected to a source. The thirteenth transistor T13 is turned on or off in accordance with a logic state of a voltage of the PQ' node PQ'-node(n−1) of a previous stage and when the thirteenth transistor T13 is turned on, the low potential voltage VGL is output to the gate of the sixth transistor T6.

Figure 12:
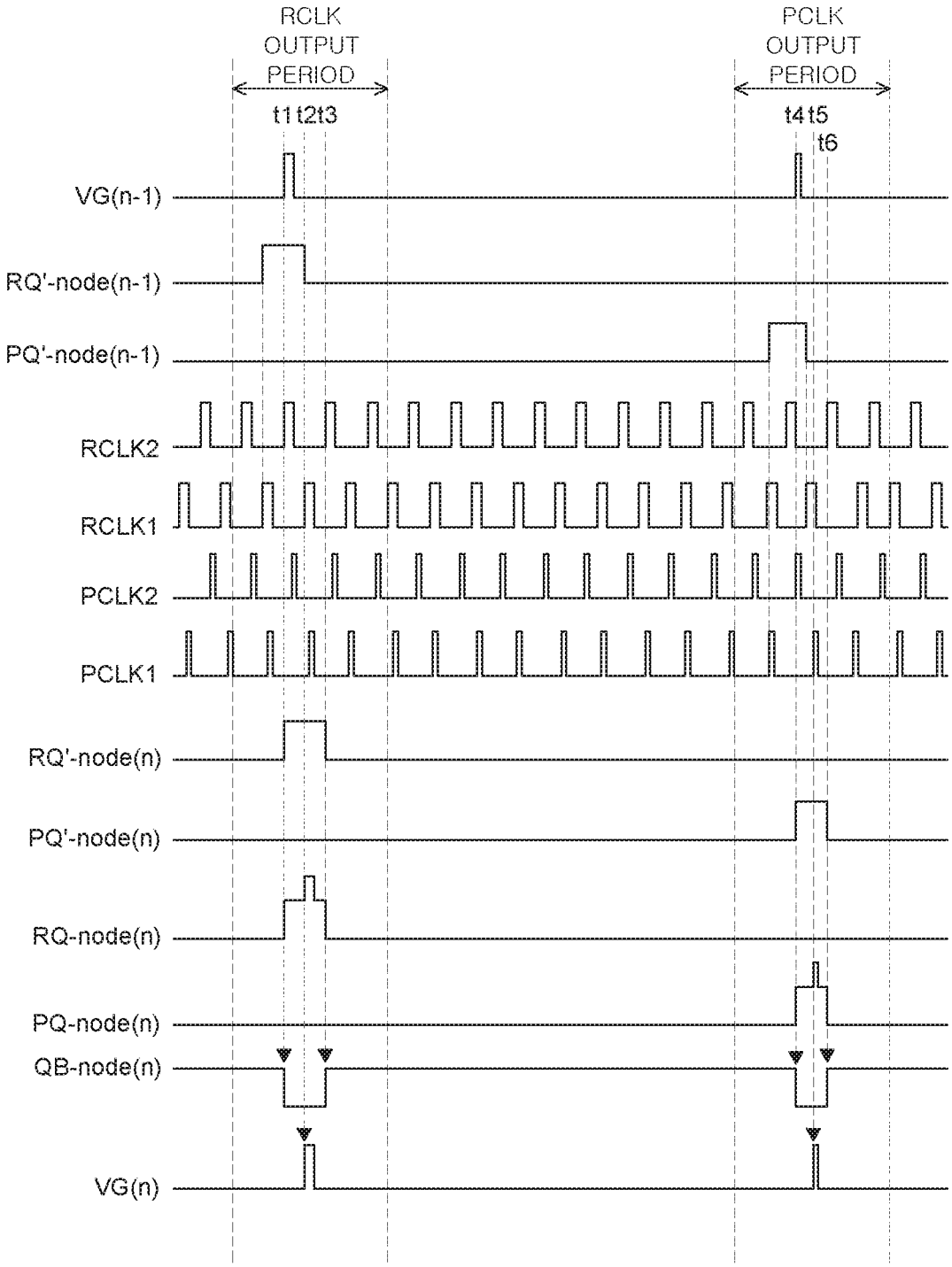
FIG. 12 is a timing chart illustrating an internal signal of each stage equipped in a gate driver of a display device according to another embodiment of the present disclosure.

FIG. 12 is a timing chart illustrating an internal signal of each stage equipped in a gate driver of a display device according to another embodiment of the present disclosure.

As illustrated in FIG. 12, each stage of a gate driver 330 of the display device according to still another embodiment of the present disclosure can be driven by dividing a period when a gate voltage VGn outputs a first clock signal RCLK and a period when the gate voltage VGn outputs a second clock signal PCLK.

First, an operation of each stage in a first clock signal RCLK output period will be described as follows.

At a timing t1, a gate voltage VG(n−1) of a previous stage and a first clock signal of a second phase RCLK2 are shifted to a high level. Therefore, the fourth transistor T4 is turned on so that a high level gate voltage VG(n−1) is applied to the RQ' node RQ'-node(n) and the RQ node RQ-node(n) via the fourth transistor T4.

And, since the high level gate voltage VG(n−1) is applied to the RQ' node RQ'-node(n) and the RQ node RQ-node(n), the first transistor T1, the seventh transistor T7, and the eighth transistor T8 whose gates are connected to the RQ' node RQ'-node(n) and the RQ node RQ-node(n) are turned on. Therefore, the first clock signal of the first phase RCLK1 is output to the n-th gate line GLn via the first transistor T1, the low potential voltage VGL is applied to the PQ node PQ-node(n) and the PQ' node PQ'-node(n) via the eighth transistor T8, and the low potential voltage VGL is applied to the QB node QB-node(n) via the seventh transistor T7.

And, since the voltage of the RQ' node RQ'-node(n−1) of the previous stage is a high level, the twelfth transistor T12 is turned on so that the low potential voltage VGL is applied to the gate of the sixth transistor T6. Therefore, the sixth transistor T6 is turned off.

By doing this, the RQ node RQ-node(n) is precharged to the high potential voltage VGH at the timing t1.

Next, at a timing t2, the first clock signal of the first phase RCLK1 is shifted to a high level. A bootstrap circuit is configured by a gate-source capacitor CRQ of the turned-on first transistor T1 and a voltage of the RQ node RQ-node(n) is bootstrapped to be raised due to the voltage shift of the first clock signal of the first phase RCLK1. By doing this, the voltage of the RQ node RQ-node(n) connected to the gate of the first transistor T1 rises and a channel of the first transistor T1 is sufficiently formed so that the high level first clock signal of the first phase RCLK1 is output to the n-th gate voltage VGn.

Next, at a timing t3, a first clock signal of a second phase RCLK2 is shifted to a high level.

In this case, since voltages of the RQ' node RQ'-node(n−1) and the PQ' node PQ'-node(n−1) of the previous stage are low levels, the twelfth transistor T12 and the thirteenth transistor T13 are turned off so that the gate of the sixth transistor T6 is in a floating state.

Therefore, the sixth transistor T6 in which a coupling voltage of the first clock signal of a second phase RCLK2 of other electrode of the capacitor Con is applied to the gate is turned on. Therefore, a high level first clock signal of a second phase RCLK2 is applied to the QB node QB-node(n) via the sixth transistor T6.

And, since the high level first clock signal of a second phase RCLK2 is applied to the QB node QB-node(n), the third transistor T3 and the tenth transistor T10 whose gates are connected to the QB node QB-node(n) are turned on.

Therefore, the low potential voltage VGL is applied to the RQ node RQ-node(n) and the RQ' node RQ'-node(n) via the tenth transistor T10 and the low potential voltage VGL is output to the n-th gate voltage VGn via the third transistor T3.

Next, an operation of each stage in a second clock signal PCLK output period will be described as follows.

At a timing t4, the gate voltage VG(n−1) of a previous stage and the second clock signal of a second phase PCLK2 are shifted to a high level. Therefore, the fifth transistor T5 is turned on so that a high level gate voltage VG(n−1) is applied to the PQ' node PQ'-node(n) and the PQ node PQ-node(n) via the fifth transistor T5.

And, since the high level gate voltage VG(n−1) is applied to the PQ' node PQ'-node(n) and the PQ node PQ-node(n), the second transistor T2 and the ninth transistor T9 whose gates are connected to the PQ' node PQ'-node(n) and the PQ node PQ-node(n) are turned on. Therefore, the second clock signal of the first phase PCLK1 is output to the n-th gate line GLn which is an output terminal via the second transistor T2 and the low potential voltage VGL is applied to the RQ node RQ-node(n) and the RQ' node RQ'-node(n) via the ninth transistor T9.

And, since the voltage of the PQ' node PQ'-node(n−1) of the previous stage is a high level, the thirteenth transistor T13 is turned on so that the low potential voltage VGL is applied to the gate of the sixth transistor T6. Therefore, the sixth transistor T6 is turned off.

By doing this, the PQ node PQ-node(n) is precharged to a high potential voltage at the timing t4.

Next, at a timing t5, the second clock signal of the first phase PCLK1 is shifted to a high level. A bootstrap circuit is configured by a gate-source capacitor CRQ of the turned-on second transistor T2 and a voltage of the PQ node PQ-node(n) is bootstrapped to be raised due to the voltage shift of the second clock signal of the first phase PCLK1. By doing this, the voltage of the PQ node PQ-node(n) connected to the gate of the second transistor T2 rises and a channel of the second transistor T2 is sufficiently formed so that the second clock signal of the first phase PCLK1 which is a high level is output to the n-th gate voltage VGn.

The first clock signal of a second phase RCLK2 is shifted to a high level.

In this case, since voltages of the RQ' node RQ'-node(n−1) and the PQ' node PQ'-node(n−1) of the previous stage are low levels, the twelfth transistor T12 and the thirteenth transistor T13 are turned off so that the gate of the sixth transistor T6 is in a floating state.

Therefore, the sixth transistor T6 in which a coupling voltage of the first clock signal of a second phase RCLK2 of another electrode of the capacitor Con is applied to the gate is turned on. Therefore, a high level first clock signal of a second phase RCLK2 is applied to the QB node QB-node(n) via the sixth transistor T6.

Since the high potential voltage VGH is applied to the QB node QB-node(n), the third transistor T3 and the eleventh transistor T11 whose gates are connected to the QB node QB-node(n) are turned on.

Therefore, the low potential voltage VGL is applied to the PQ node PQ-node(n) and the PQ' node PQ'-node(n) via the eleventh transistor T11 and the low potential voltage VGL is output to the n-th gate voltage VGn via the third transistor T3.

By the above-described processes, the gate driver 330 of the display device according to another embodiment of the present disclosure sequentially outputs gate voltages VG1 to VGz which selectively includes the first clock signal RCLK and the second clock signal PCLK having different phases.

As described above, the gate driver 330 of the display device according to another embodiment of the present disclosure outputs the first clock signal RCLK and the second clock signal PCLK having different phase so that a gate voltage for writing data and a gate voltage for suppressing the lowering of the luminance are output at different timings during the writing period.

Therefore, a data voltage which will be applied to a pixel connected to a specific gate line is not applied to pixels connected to the remaining gate lines so that the above-described image output failure can be solved.

The embodiments of the present disclosure can also be described as follows.

According to an aspect of the present disclosure, a gate driver is provided. The gate driver includes a plurality of stages which are dependently connected to each other, each of the plurality of stages includes an output unit which outputs a gate voltage by a voltage of an RQ node, a voltage of a PQ node, and a voltage of a QB node, a first controller which controls the RQ node, a second controller which controls the PQ node, and a third controller which controls the QB node, and the gate voltage is configured by a first clock signal having a first phase and a second clock signal having a second phase which is different from the first phase.

According to another aspect of the present disclosure, the first clock signal can be applied to the first controller and the second clock signal can be applied to the second controller.

According to still another aspect of the present disclosure, a pulse width of the first clock signal can be different from a pulse width of the second clock signal.

According to still another aspect of the present disclosure, the output unit can include a first transistor which outputs the first clock signal as the gate voltage in accordance with the voltage of the RQ node, a second transistor which outputs the second clock signal as the gate voltage in accordance with the voltage of the PQ node, and a third transistor which outputs a low potential voltage as the gate voltage in accordance with the voltage of the QB node.

According to still another aspect of the present disclosure, the first controller can include a fifth transistor which outputs a high potential voltage to the RQ node in accordance with a voltage of an RQ node of a previous stage, a tenth transistor which outputs a low potential voltage to the RQ node in accordance with the voltage of the PQ node, and a thirteenth transistor which outputs the low potential voltage to the RQ node in accordance with the voltage of the QB node, the second controller can include a sixth transistor which outputs the low potential voltage to the PQ node in accordance with the voltage of the RQ node, a ninth transistor which outputs the high potential voltage to the PQ node in accordance with a voltage of a PQ node of the previous stage, and a fourteenth transistor which outputs the low potential voltage to the PQ node in accordance with the voltage of the QB node, and the third controller can include a seventh transistor which outputs the low potential voltage to the QB node in accordance with the voltage of the RQ node, an eleventh transistor which outputs the low potential voltage to the QB node in accordance with the voltage of the PQ node, and a twelfth transistor which outputs the high potential voltage to the QB node in accordance with the second clock signal.

According to still another aspect of the present disclosure, the first controller can include a fourth transistor which outputs a gate voltage of a previous stage to the RQ node in accordance with the first clock signal, an eighth transistor which outputs a low potential voltage to the RQ node in accordance with the voltage of the PQ node, and a tenth transistor which outputs the low potential voltage to the RQ node in accordance with the voltage of the QB node, the second controller can include a fifth transistor which outputs the gate voltage of the previous stage to the PQ node in accordance with the second clock signal, a seventh transistor which outputs the low potential voltage to the PQ node in accordance with the voltage of the RQ node, and an eleventh transistor which outputs the low potential voltage to the PQ node in accordance with the voltage of the QB node, and the third controller can include a sixth transistor which outputs the low potential voltage to the QB node in accordance with the gate voltage of the previous stage and a ninth transistor which outputs the high potential voltage to the QB node in accordance with the second clock signal.

According to still another aspect of the present disclosure, the first controller can include a fourth transistor which outputs a gate voltage of a previous stage to the RQ node in accordance with the first clock signal, a ninth transistor which outputs a low potential voltage to the RQ node in accordance with the voltage of the PQ node, and a tenth transistor which outputs the low potential voltage to the RQ node in accordance with the voltage of the QB node, the second controller can include a fifth transistor which outputs the gate voltage of the previous stage to the PQ node in accordance with the second clock signal, an eighth transistor which outputs the low potential voltage to the PQ node in accordance with the voltage of the RQ node, and an eleventh transistor which outputs the low potential voltage to the PQ node in accordance with the voltage of the QB node, and the third controller can include a sixth transistor which outputs the first clock signal to the QB node in accordance with the first clock signal and a seventh transistor which outputs the low potential voltage to the QB node in accordance with the voltage of the RQ node.

According to another aspect of the present disclosure, a display device is provided. The display device includes a display panel, a gate driver which is in the display panel to output a gate voltage, and a data driver which outputs a data voltage during a writing period and outputs a reference voltage during a sustain period, and the gate voltage is configured by a first clock signal having a first phase and a second clock signal having a second phase which is different from the first phase.

According to another aspect of the present disclosure, the gate driver can output a gate voltage including both the first clock signal and the second clock signal during the writing period and outputs a gate voltage including only the second clock signal during the sustain period.

According to still another aspect of the present disclosure, the gate driver can output a gate voltage including only the first clock signal during the writing period and outputs a gate voltage including only the second clock signal during the sustain period.

Although the embodiments of the present disclosure have been described in detail with reference to the accompanying drawings, the present disclosure is not limited thereto and can be embodied in many different forms without departing from the technical concept of the present disclosure. Therefore, the embodiments of the present disclosure are provided for illustrative purposes only but not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gate driver, comprising:

a plurality of stages which are dependently connected to each other, wherein each of the plurality of stages includes:

an output unit which outputs a gate voltage by a voltage of an RQ node, a voltage of a PQ node, and a voltage of a QB node;

a first controller which controls the RQ node;

a second controller which controls the PQ node; and a third controller which controls the QB node, and wherein the gate voltage is configured by a first clock signal and a second clock signal which is different from the first clock signal, wherein the first controller includes:

a fourth transistor which outputs a gate voltage of a previous stage to the RQ node in accordance with the first clock signal;

a ninth transistor which outputs a low potential voltage to the RQ node in accordance with the voltage of the PQ node; and a tenth transistor which outputs the low potential voltage to the RQ node in accordance with the voltage of the QB node, wherein the second controller includes:

a fifth transistor which outputs the gate voltage of the previous stage to the PQ node in accordance with the second clock signal;

an eighth transistor which outputs the low potential voltage to the PQ node in accordance with the voltage of the RQ node; and an eleventh transistor which outputs the low potential voltage to the PQ node in accordance with the voltage of the QB node, and wherein the third controller includes:

a sixth transistor which outputs the first clock signal to the QB node in accordance with the first clock signal; and a seventh transistor which outputs the low potential voltage to the QB node in accordance with the voltage of the RQ node.

2. The gate driver according to claim 1, wherein the first clock signal is applied to the first controller and the second clock signal is applied to the second controller.

3. The gate driver according to claim 1, wherein a pulse width of the first clock signal is different from a pulse width of the second clock signal.

4. The gate driver according to claim 1, wherein the output unit includes:

a first transistor which outputs the first clock signal as the gate voltage in accordance with the voltage of the RQ node;

a second transistor which outputs the second clock signal as the gate voltage in accordance with the voltage of the PQ node; and a third transistor which outputs a low potential voltage as the gate voltage in accordance with the voltage of the QB node.

5. The display device according to claim 1, wherein the first clock signal has a first phase and a second phase, wherein the second clock signal has a first phase and a second phase, wherein the first phase of the first clock signal is different from the second phase of the second clock signal.

6. The display device according to claim 5, wherein the first clock signal outputted by the first transistor is the first phase of the first clock signal, wherein the first clock signal controlled to the fourth transistor is the second phase of the first clock signal.

7. The display device according to claim 5, wherein the second clock signal outputted by the second transistor is the first phase of the second clock signal, wherein the second clock signal controlled to the fifth transistor is the second phase of the second clock signal.

8. The display device according to claim 1, wherein each of the plurality of stages further comprises a sixth transistor controller, wherein the sixth transistor controller includes:

a twelfth transistor which outputs the low potential voltage to a gate of the sixth transistor in accordance with the voltage of the RQ node of a previous stage;

a thirteenth transistor which outputs the low potential voltage to the gate of the sixth transistor in accordance with the voltage of the PQ node of a previous stage; and a capacitor having two electrodes, one electrode of the two electrodes is connected to a line which supplies the first clock signal, the other electrode of the two electrodes is connected to the gate of the sixth transistor.

9. A display device, comprising:

a display panel;

a gate driver disposed in the display panel to output a gate voltage; and a data driver which outputs a data voltage during a writing period and outputs a reference voltage during a sustain period, wherein the gate voltage is configured by a first clock signal and a second clock signal which is different from the first clock signal, wherein the gate driver includes a plurality of stages which are dependently connected to each other, wherein each of the plurality of stages includes:

an output unit which outputs a gate voltage by a voltage of an RQ node, a voltage of a PQ node, and a voltage of a QB node;

a first controller which is applied with the first clock signal to control the RQ node;

a second controller which is applied with the second clock signal to control the PQ node; and a third controller which controls the QB node, wherein the first controller includes:

a fourth transistor which outputs a gate voltage of a previous stage to the RQ node in accordance with the first clock signal;

a ninth transistor which outputs a low potential voltage to the RQ node in accordance with the voltage of the PQ node; and a tenth transistor which outputs the low potential voltage to the RQ node in accordance with the voltage of the QB node, wherein the second controller includes:

a fifth transistor which outputs the gate voltage of the previous stage to the PQ node in accordance with the second clock signal;

an eighth transistor which outputs the low potential voltage to the PQ node in accordance with the voltage of the RQ node; and an eleventh transistor which outputs the low potential voltage to the PQ node in accordance with the voltage of the QB node, and wherein the third controller includes:

a sixth transistor which outputs the first clock signal to the QB node in accordance with the first clock signal; and a seventh transistor which outputs the low potential voltage to the QB node in accordance with the voltage of the RQ node.

10. The display device according to claim 9, wherein the gate driver outputs a gate voltage including both the first clock signal and the second clock signal during the writing period, and outputs a gate voltage including only the second clock signal during the sustain period.

11. The display device according to claim 9, wherein the gate driver outputs a gate voltage including only the first clock signal during the writing period, and outputs a gate voltage including only the second clock signal during the sustain period.

12. The display device according to claim 9, wherein a pulse width of the first clock signal is different from a pulse width of the second clock signal.

13. The display device according to claim 9, wherein the output unit includes:

a first transistor which outputs the first clock signal as the gate voltage in accordance with the voltage of the RQ node;

a second transistor which outputs the second clock signal as the gate voltage in accordance with the voltage of the PQ node; and a third transistor which outputs a low potential voltage as the gate voltage in accordance with the voltage of the QB node.

14. The display device according to claim 9, wherein the first clock signal has a first phase and a second phase, wherein the second clock signal has a first phase and a second phase, wherein the first phase of the first clock signal is different from the second phase of the second clock signal.

15. The display device according to claim 14, wherein the first clock signal outputted by the first transistor is the first phase of the first clock signal, wherein the first clock signal controlled to the fourth transistor is the second phase of the first clock signal.

16. The display device according to claim 14, wherein the second clock signal outputted by the second transistor is the first phase of the second clock signal, wherein the second clock signal controlled to the fifth transistor is the second phase of the second clock signal.

17. The display device according to claim 9, wherein each of the plurality of stages further comprises a sixth transistor controller, wherein the sixth transistor controller includes:

a twelfth transistor which outputs the low potential voltage to a gate of the sixth transistor in accordance with the voltage of the RQ node of a previous stage;

a thirteenth transistor which outputs the low potential voltage to the gate of the sixth transistor in accordance with the voltage of the PQ node of a previous stage; and a capacitor having two electrodes, one electrode of the two electrodes is connected to a line which supplies the first clock signal, the other electrode of the two electrodes is connected to the gate of the sixth transistor.

* * * * *